US012745858B2

(12) United States Patent
Hu

(10) Patent No.: US 12,745,858 B2
(45) Date of Patent: Sep. 29, 2026

(54) CHILD CARE APPARATUS

(71) Applicant: Wonderland Switzerland AG, Steinhausen (CH)

(72) Inventor: Junjie Hu, Guangdong (CN)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 18/201,519

(22) Filed: May 24, 2023

(65) Prior Publication Data

US 2023/0292932 A1 Sep. 21, 2023

Related U.S. Application Data

(63) Continuation of application No. 17/024,386, filed on Sep. 17, 2020, now Pat. No. 11,700,953.

(30) Foreign Application Priority Data

Sep. 18, 2019 (CN) ..... 201910881564.3
Sep. 18, 2019 (CN) ..... 201910882253.9

(51) Int. Cl.
*A47D 9/02* (2006.01)
*A47D 9/00* (2006.01)

(52) U.S. Cl.
CPC ..... *A47D 9/02* (2013.01); *A47D 9/012* (2022.08)

(58) Field of Classification Search
CPC ..... A47D 9/02; A47D 9/012
USPC ..... 5/108
See application file for complete search history.

(56) References Cited

U.S. PATENT DOCUMENTS 1,366,706 A * 1/1921 Schoell ..... A61C 8/00 70/120
D139,630 S * 12/1944 Wade ..... 5/108
2,787,154 A * 4/1957 Wesberry ..... E05C 9/041 70/118
3,568,583 A * 3/1971 Horberg, Jr. ..... G03B 15/00 396/20

(Continued)

FOREIGN PATENT DOCUMENTS

CN 201167750 Y 12/2008
CN 204708424 U 10/2015

(Continued)

OTHER PUBLICATIONS

Extended European Search Report in corresponding European patent application No. 24201583.2 issued on Oct. 25, 2024.

(Continued)

*Primary Examiner* — Justin C Mikowski
*Assistant Examiner* — Luke Hall
(74) *Attorney, Agent, or Firm* — NZ Carr Law Office

(57) ABSTRACT

A child care apparatus includes a standing frame including a mounting portion, a child support frame held on the standing frame via at least two hanging bars, the two hanging bars and the mounting portion being disposed at a same side of the child support frame, the two hanging bars being respectively connected pivotally with the mounting portion at two spaced-apart locations so that the two hanging bars are rotatable for swinging the child support frame, and a latching mechanism assembled with the mounting portion of the standing frame, the latching mechanism being operable to rotationally lock and unlock the two hanging bars with respect to the mounting portion.

13 Claims, 37 Drawing Sheets

(56) References Cited

U.S. PATENT DOCUMENTS 3,815,349 A * 6/1974 Gardella ..... F16D 7/08 192/24
4,205,876 A * 6/1980 Cetina ..... A47D 1/103 297/118
4,470,277 A * 9/1984 Uyeda ..... E05B 65/0075 70/284
4,671,086 A * 6/1987 Fogleman ..... E05B 47/0603 70/279.1
4,941,453 A * 7/1990 Shakas ..... A47D 9/057 D6/390
4,987,624 A * 1/1991 Nafti ..... A47D 9/057 74/30
5,217,262 A * 6/1993 Kurosaki ..... E05C 19/022 292/6
5,487,289 A * 1/1996 Otto, III ..... E05C 9/047 70/279.1
6,626,766 B1 * 9/2003 Hsia ..... A47D 13/105 5/108
7,354,352 B2 * 4/2008 Keska ..... A47D 13/105 5/108
7,381,138 B2 * 6/2008 Dillner ..... A47D 13/105 5/108
8,550,927 B2 * 10/2013 Hunter-Jones ..... A47D 9/02 5/108
2004/0012210 A1 * 1/2004 Guidetti ..... F16B 2/246 292/303
2009/0031495 A1 * 2/2009 Wang ..... A47D 9/057 5/108
2013/0186698 A1 * 7/2013 Sarokhan ..... B62B 5/026 180/7.1
2014/0018179 A1 * 1/2014 Mountz ..... A47D 9/016 472/119
2015/0173840 A1 * 6/2015 Lohmeier ..... A61B 17/00 606/130
2015/0342367 A1 * 12/2015 Corso ..... A47D 13/105 5/101
2015/0342368 A1 * 12/2015 Corso ..... A47D 9/053 297/354.12
2016/0000232 A1 * 1/2016 Horst ..... A47D 5/00 5/655
2016/0198864 A1 * 7/2016 Yang ..... A47D 9/012 5/655
2016/0227939 A1 8/2016 Tadipatri et al.
2016/0286979 A1 * 10/2016 Sclare ..... A47D 9/016
2017/0251828 A1 * 9/2017 Kapanzhi ..... A47D 9/053
2017/0280892 A1 * 10/2017 Zhang ..... A47D 13/063
2017/0360216 A1 * 12/2017 Sclare ..... A47D 9/02
2017/0367495 A1 * 12/2017 Yu ..... A47D 1/002
2018/0035821 A1 * 2/2018 Bass-Conn ..... A47D 9/00
2018/0206652 A1 * 7/2018 Gallina ..... A47D 9/012
2019/0099012 A1 * 4/2019 Zhang ..... A47D 13/06
2019/0390704 A1 * 12/2019 Hayashi ..... F16C 11/06
2020/0024866 A1 * 1/2020 Hartmann ..... E05B 37/02
2020/0240480 A1 * 7/2020 Hodge ..... F16D 41/16
2021/0107127 A1 * 4/2021 Chou ..... B25C 5/025

FOREIGN PATENT DOCUMENTS

CN 104382420 B 12/2017
CN 208403890 U 1/2019
GB 137633 A 1/1920

OTHER PUBLICATIONS

Office Action in corresponding Australian patent application No. 2024219874.

* cited by examiner

200

200

200

CHILD CARE APPARATUS

CROSS-REFERENCE TO RELATED APPLICATION(S)

This application is a continuation application of U.S. patent application Ser. No. 17/024,386 filed on Sep. 17, 2020, which claims priority to China patent application no. 201910881564.3 filed on Sep. 18, 2019 and to China patent application no. 201910882253.9 filed on Sep. 18, 2019.

BACKGROUND

1. Field of the Invention

The present invention relates to a child care apparatus having a swingable child support.

2. Description of the Related Art

Baby cribs can provide a comfortable and safe environment for sleeping a young child. For helping the child to fall asleep, the baby crib may include a child support that can be swung in use. When the child is sleeping or the baby crib is not used, the child support may be locked in position to avoid undesirable disturbance. However, the latching mechanism for locking the child support is usually complex in construction, and may not satisfy current needs.

Therefore, there is a need for a child care apparatus that can be convenient to use, and address at least the foregoing issues.

SUMMARY

The present application describes a child care apparatus having a child support frame that can be swung or locked in position as needed.

According to one embodiment, the child care apparatus includes a standing frame including a mounting portion, a child support frame held on the standing frame via at least two hanging bars, the two hanging bars and the mounting portion being disposed at a same side of the child support frame, the two hanging bars being respectively connected pivotally with the mounting portion at two spaced-apart locations and being rotatable for swinging the child support frame, and a latching mechanism assembled with the mounting portion of the standing frame, the latching mechanism being operable to rotationally lock and unlock the two hanging bars with respect to the mounting portion.

DETAILED DESCRIPTION OF THE EMBODIMENTS

The present application provides a child care apparatus that includes a standing frame, and a child support frame connected with the standing frame via hanging bars. The hanging bars are rotatable to swing the child support frame relative to the standing frame for soothing a child. Moreover, the child support frame can be locked in position by a latching mechanism operable to rotationally lock the hanging bars, which can prevent swinging of the child support frame. Embodiments of the child care apparatus described herein include baby cribs. However, it will be appreciated that child care apparatuses that may incorporate the structures and features described herein can include, without limitation, child swings, child rockers, child motion apparatuses, and the like.

Figure 1:
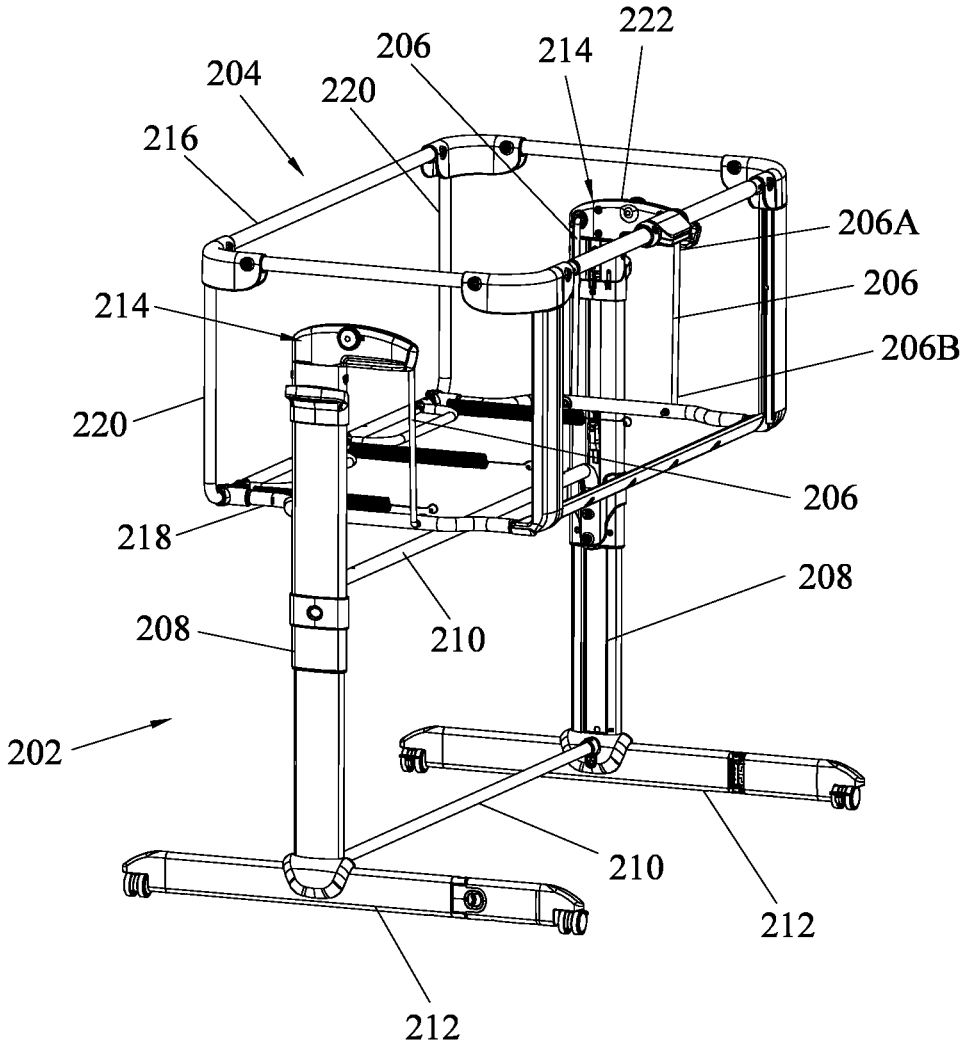
FIG. 1 is a perspective view illustrating an embodiment of a child care apparatus.
Figure 2:
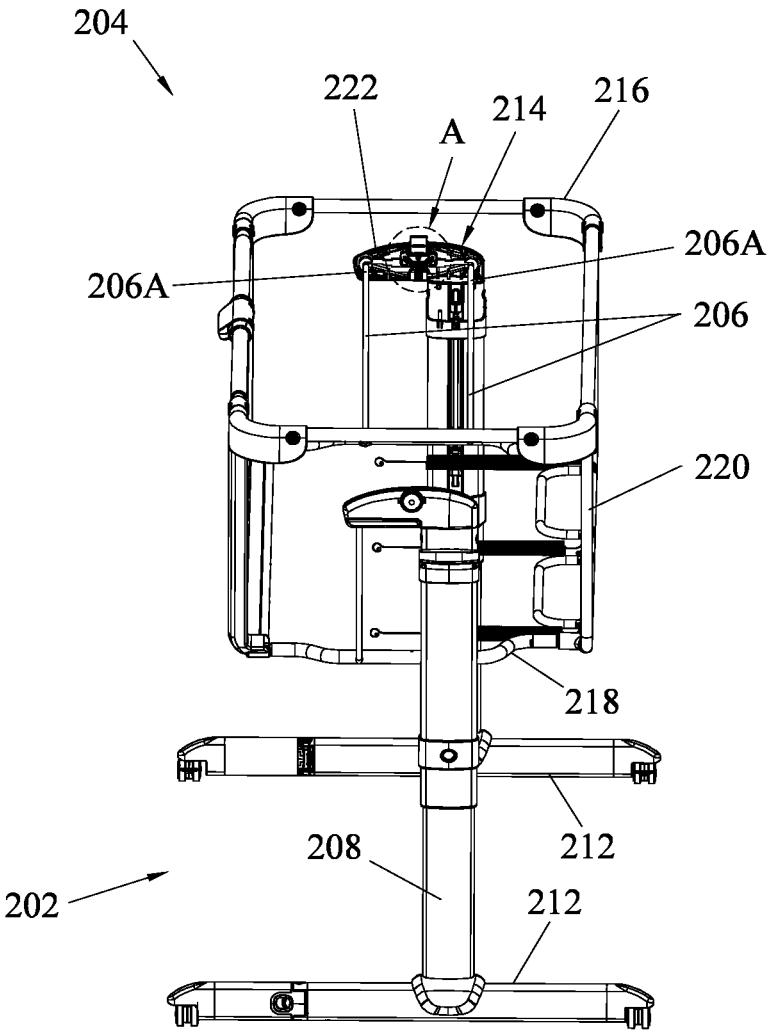
FIG. 2 is another perspective view of the child care apparatus shown in FIG. 1.

FIGS. 1 and 2 are two perspective views illustrating an embodiment of a child care apparatus 200, which is exemplarily a baby crib. Referring to FIGS. 1 and 2, the child care apparatus 200 can include a standing frame 202, and a child support frame 204 held on the standing frame 202 via a plurality of hanging bars 206. According to an example of construction, the standing frame 202 can include two support legs 208 that are spaced apart from each other and can extend generally along an upright direction, and one or more transversal bar 210 connected with the two support legs 208 below the child support frame 204. Each support leg 208 can have a lower end connected with a foot portion 212, and an upper end connected with a mounting portion 214. The foot portions 212 can provide stable support for the child care apparatus 200 on a floor surface. The two mounting portions 214 can be respectively connected fixedly with the two support legs 208. Moreover, each mounting portion 214 can be pivotally connected with one or more hanging bar 206, which can extend downward from the mounting portion 214 and can be connected with the child support frame 204 below the mounting portion 214.

Referring to FIGS. 1 and 2, the child support frame 204 provides a rigid support to which a fabric and/or softgoods can be attached to define an interior space suitable to receive a young child. According to an example of construction, the child support frame 204 can include an upper frame portion 216, a lower frame portion 218, and a plurality of upright posts 220 connected with the upper and lower frame portions 216 and 218. The upper frame portion 216, the lower frame portion 218 and the upright posts 220 can include a plurality of rigid tubes and/or bars, which can be assembled to define an enclosure frame.

According to an example of construction, the child support frame 204 can be placed between the two support legs 208 so that two opposite sides of the child support frame 204 are respectively adjacent to the two support legs 208, and four hanging bars 206 can be provided for linking the two opposite sides of the child support frame 204 to the two mounting portions 214 of the support legs 208. More specifically, two parallel hanging bars 206 can respectively couple each of the two opposite sides of the child support frame 204 to one corresponding mounting portion 214. For example, each hanging bar 206 can have an upper portion 206A pivotally connected with the mounting portion 214, and a lower end 206B pivotally connected with the child support frame 204. According to an example of construction, the mounting portion 214 can include a housing 222 having a cavity that is fixedly connected with the support leg 208 at a top thereof, the upper portion 206A of the hanging bar 206 can be pivotally connected with the housing 222, and the lower end 206B of the hanging bar 206 can be pivotally connected with the lower frame portion 218 of the child support frame 204. Accordingly, the hanging bars 206 can hold the child support frame 204 at an elevated position above a floor surface, and are rotatable relative to the standing frame 202 for swinging the child support frame 204 between the two support legs 208. According to an example of construction, the child support frame 204 may be held at an elevated position above a floor surface and protrude higher than the mounting portions 214, which may facilitate access to the child support frame 204 and provide improved visibility. Owing to the pivot connection of the hanging bars 206 with the child support frame 204, the child support frame 204 may remain in a same horizontal orientation during the swing motion.

In conjunction with FIGS. 1 and 2, FIGS. 3 and 4 are respectively an enlarged view and an exploded view illustrating a latching mechanism 100 for rotationally locking the hanging bars 206 and thereby preventing swinging of the child support frame 204 relative to the standing frame 202. Referring to FIGS. 1-4, the latching mechanism 100 can be assembled with the standing frame 202, and is operable to engage for locking and disengage for unlocking the hanging bars 206 as desired. More specifically, the latching mechanism 100 may be disposed adjacent to the mounting portion 214 of one support leg 208, and is operable to engage and lock the two hanging bars 206 that are pivotally connected with the mounting portion 214 of the same support leg 208. According to an example of construction, two of the same latching mechanism 100 may be respectively provided on the mounting portions 214 of the two support legs 208.

Referring to FIGS. 1-4, the latching mechanism 100 can include two latches 102, a latch actuator 104 and a spring 108, which can be assembled with the housing 222 of the mounting portion 214.

The two latches 102 can be connected with the housing 222 so as to operate in a symmetric manner. For example, the two latches 102 can move relative to the housing 222 away from each other to engage and rotationally lock the two hanging bars 206, and can move toward each other to disengage and rotationally unlock the two hanging bars 206. According to an example of construction, the two latches 102 can be slidably connected with the housing 222, whereby the two latches 102 can slide toward each other to disengage and rotationally unlock the two hanging bars 206 and can slide away from each other to engage and rotationally lock the two hanging bars 206. For example, the housing 222 may include two elongate slots 224 (better shown in FIG. 14), and the two latches 102 can respectively include two pins that are slidably received through the two elongate slots 224. The elongate slots 224 can generally extend horizontally. The two latches 102 can thereby slide along an axis 112 that can be substantially orthogonal to the respective pivot axes of the hanging bars 206.

For facilitating the respective engagement of the two latches 102 with the two hanging bars 206, the two hanging bars 206 can respectively have two bar extensions 114 that extend into the housing 222. Each bar extension 114 may extend at an angle (e.g., 90 degrees) relative to the hanging bar 206. According to an example of construction, the two bar extensions 114 can be respectively attached fixedly to the upper portions 206A of the two hanging bars 206. According to another example of construction, the bar extensions 114 may be respectively formed integrally with the hanging bars 206. The two latches 102 can respectively engage with two notches 114A provided on the bar extensions 114 to rotationally lock the two hanging bars 206.

Referring to FIGS. 1-4, the latch actuator 104 is movably linked to the two latches 102, and is operable to cause the two latches 102 to concurrently move for rotationally locking and unlocking the two hanging bars 206. For example, the latch actuator 104 can move in a direction to urge the two latches 102 to concurrently move toward each other for disengaging and rotationally unlocking the two hanging bars 206, and can move in an opposite direction to urge the two latches 102 to concurrently move away from each other for engaging and rotationally locking the two hanging bars 206.

According to an example of construction, the latch actuator 104 can be a single part having an operating portion 116, can be slidably connected with the two latches 102, and can be slidably connected with the housing 222 for sliding along an axis 118 substantially orthogonal to the axis 112. For example, the housing 222 can have a channel 222A for guiding a sliding movement of the latch actuator 104 relative to the mounting portion 214 along the axis 118, wherein the axis 118 can exemplarily extend vertically. The sliding connection of the latch actuator 104 with the two latches 102 can include, e.g., two pins respectively provided on the two latches 102 that are respectively received slidably through two guide slots 120 provided in the latch actuator 104. The two guide slots 120 can be tilted relative to the axis 112, and can be disposed according to a symmetric arrangement in the latch actuator 104. In this manner, the two latches 102 can concurrently slide toward each other for respectively disengaging from the two hanging bars 206 when the latch actuator 104 slides in one direction along the axis 118, and the two latches 102 can concurrently slide away from each other for respectively engaging with the two hanging bars 206 when the latch actuator 104 slides in an opposite direction along the axis 118.

According to an example of construction, the latch actuator 104 may be disposed in a region overlapping with the two bar extensions 114 for a compact arrangement. As the hanging bars 206 rotate for swinging the child support frame 204, the bar extensions 114 can travel past the latch actuator 104. For facilitating the passage of the bar extensions 114, the latch actuator 104 can have an inner cavity 122 that is connected with the two guide slots 120 and is opened at a left and a right side of the latch actuator 104. The bar extensions 114 can travel through the inner cavity 122 of the latch actuator 104 as the hanging bars 206 rotate for swinging the child support frame 204. According to an example of construction, the latches 102 can respectively engage with the notches 114A of the bar extensions 114 while the notches 114A are positioned inside the inner cavity 122 of the latch actuator 104.

With the aforementioned construction, the latch actuator 104 can move along with the latches 102 relative to the mounting portion 214 between a locking state where the latches 102 can be respectively engaged with the hanging bars 206, and an unlocking state where the latches 102 can be respectively disengaged from the hanging bars 206. The operating portion 116 of the latch actuator 104 is exposed for operation, and can protrude outside the mounting portion 214 when the latch actuator 104 is in the unlocking state and can be displaced toward the interior of the mounting portion 214 when the latch actuator 104 is in the locking state.

Figure 3:
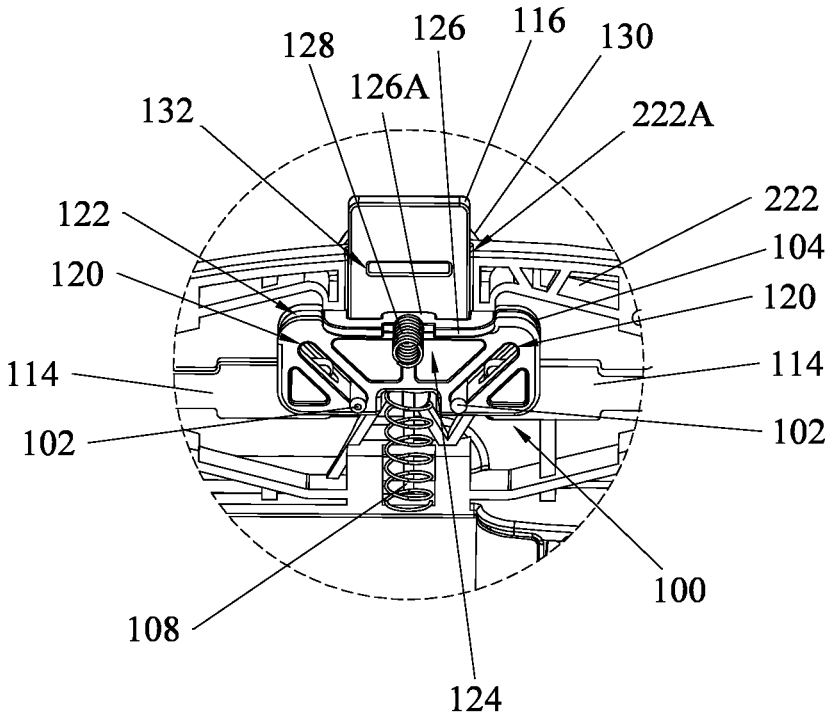
FIG. 3 is an enlarged view of a portion A shown in FIG. 2.
Figure 4:
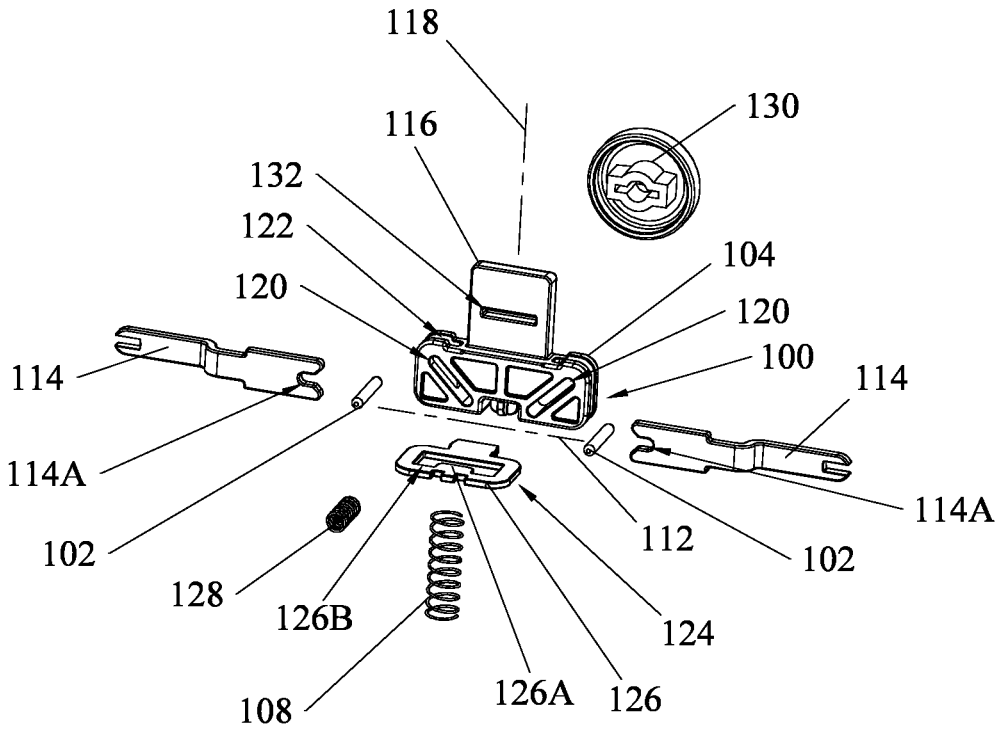
FIG. 4 is an exploded view illustrating a latching mechanism for preventing a child support frame of the child care apparatus from swinging and a holding mechanism for keeping the latching mechanism in a locking state.

Referring to FIGS. 3 and 4, the spring 108 can bias the latch actuator 104 toward the unlocking state, i.e., in a direction that displaces the operating portion 116 toward an outer side of the housing 222. According to an example of construction, the spring 108 can be a compression spring having one end connected with the latch actuator 104 and another end connected with an anchor structure provided in the housing 222. For switching the latch actuator 104 from the unlocking state to the locking state, a caregiver can push the operating portion 116 toward the interior of the housing 222 so that the latch actuator 104 can move to the locking state against the biasing force of the spring 108.

Referring to FIGS. 3 and 4, since the latching mechanism 100 is biased toward the unlocking state by the spring 108, a holding mechanism 124 can be provided for keeping the latch actuator 104 and the latches 102 in the locking state. According to an example of construction, the holding mechanism 124 can include a locking part 126, a spring 128 and a release button 130, which can be assembled with the housing 222 of the mounting portion 214. The locking part 126 is movable to engage with the latch actuator 104 for keeping the latch actuator 104 and the latches 102 in the locking state against the biasing force of the spring 108, and to disengage from the latch actuator 104 so that the latch actuator 104 and the latches 102 can move under the biasing force of the spring 108 from the locking state to the unlocking state. For example, the locking part 126 can have a protrusion 126A that can engage with or disengage from an opening 132 provided in the operating portion 116 of the latch actuator 104 for locking or releasing the latch actuator 104.

Referring to FIGS. 3 and 4, the locking part 126 can be provided as a single part, and can be slidably connected with the housing 222. For a compact assembly, the locking part 126 can be disposed adjacent to the latch actuator 104 with the operating portion 116 of the latch actuator 104 passing through an opening 126B provided in the locking part 126, the locking part 126 being slidable along an axis that is substantially orthogonal to the axis 118. The locking part 126 can thereby slide relative to the mounting portion 214 for engaging with or disengaging from the latch actuator 104.

Referring to FIGS. 3 and 4, the spring 128 can have two opposite ends respectively connected with the locking part 126 and the housing 222, and can bias the locking part 126 for engagement with the latch actuator 104. The release button 130 can be fixedly connected with the locking part 126, and can be exposed on the mounting portion 214 for operation. According to an example of construction, the spring 128 and the release button 130 can be disposed at two opposite sides of the locking part 126. The release button 130 is operable to urge the locking part 126 to move against the biasing force of the spring 128 for disengaging from the latch actuator 104.

In conjunction with FIGS. 1-4, FIGS. 5-10 are schematic views illustrating exemplary operation of the latching mechanism 100 and the holding mechanism 124. Referring to FIGS. 1-3, the holding mechanism 124 is shown in a configuration where the locking part 126 is disengaged from the latch actuator 104, and the latching mechanism 100 is in the unlocking state with the operating portion 116 of the latch actuator 104 protruding outside the mounting portion 214 and the latches 102 respectively disengaged from the bar extensions 114 of the hanging bars 206. The latching mechanism 100 can be kept in the unlocking state by the biasing force of the spring 108. Accordingly, the hanging bars 206 are unlocked and can rotate relative to the mounting portion 214 for swinging the child support frame 204.

Figure 5:
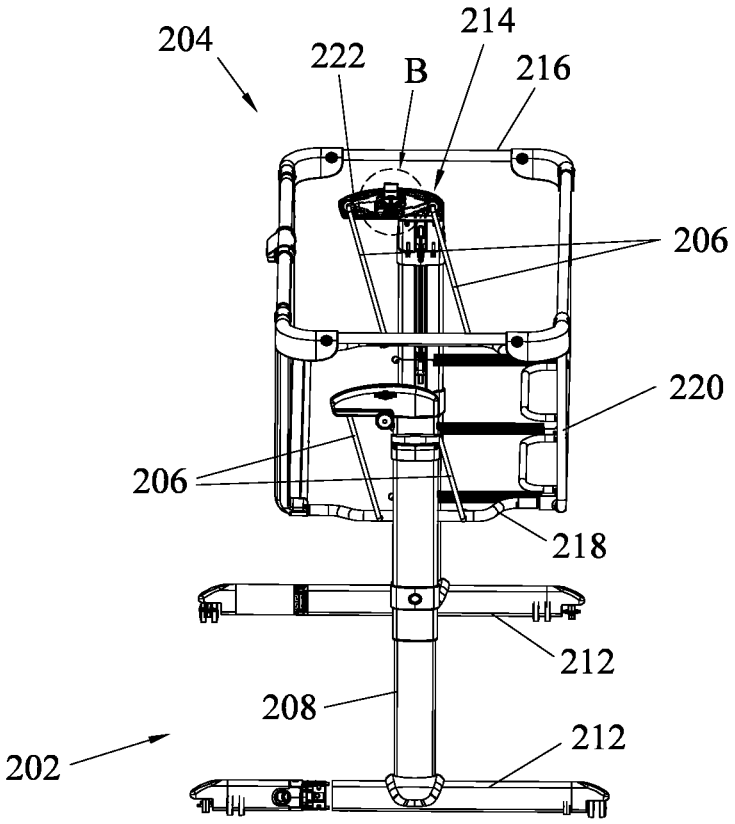
FIG. 5 is a perspective view illustrating the child care apparatus with the child support frame swung to one side.
Figure 6:
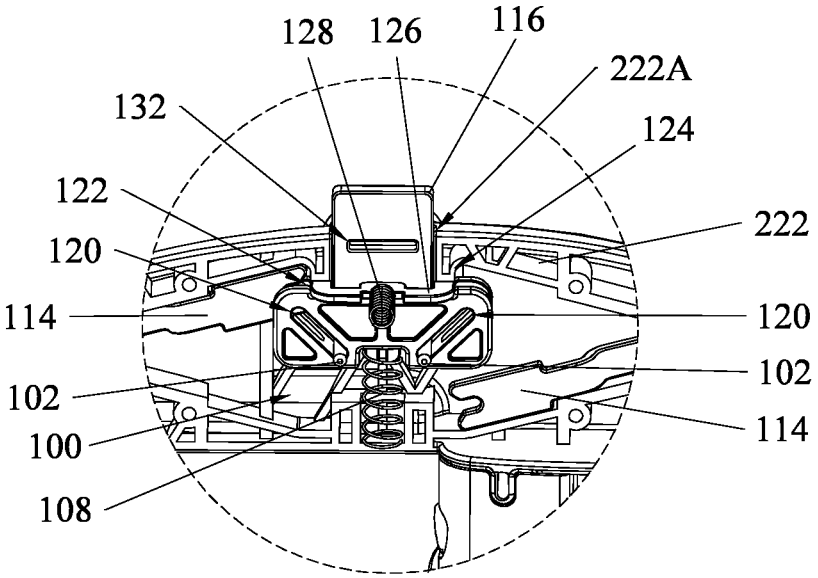
FIG. 6 is an enlarged view of portion B shown in FIG. 5.
Figure 7:
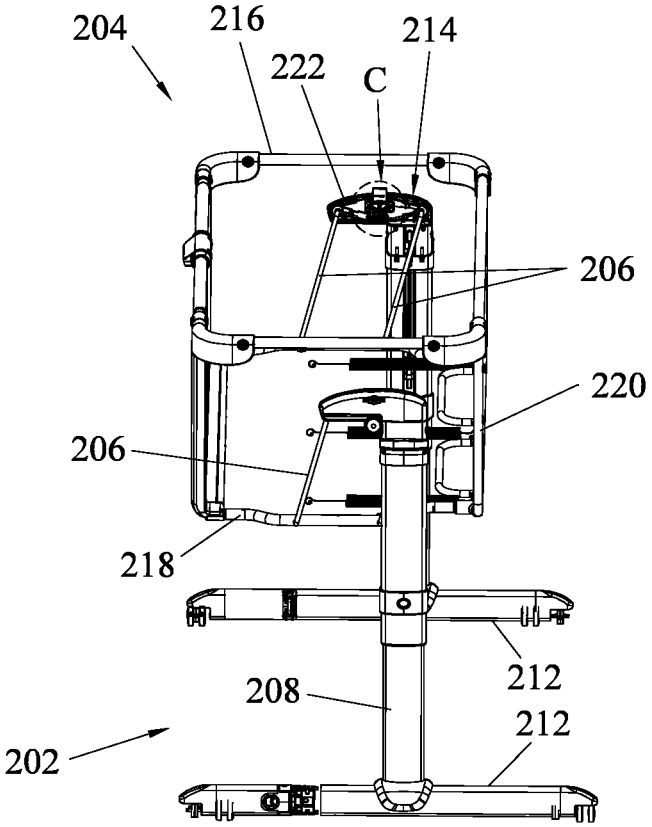
FIG. 7 is a perspective view illustrating the child care apparatus with the child support frame swung to another side.
Figure 8:
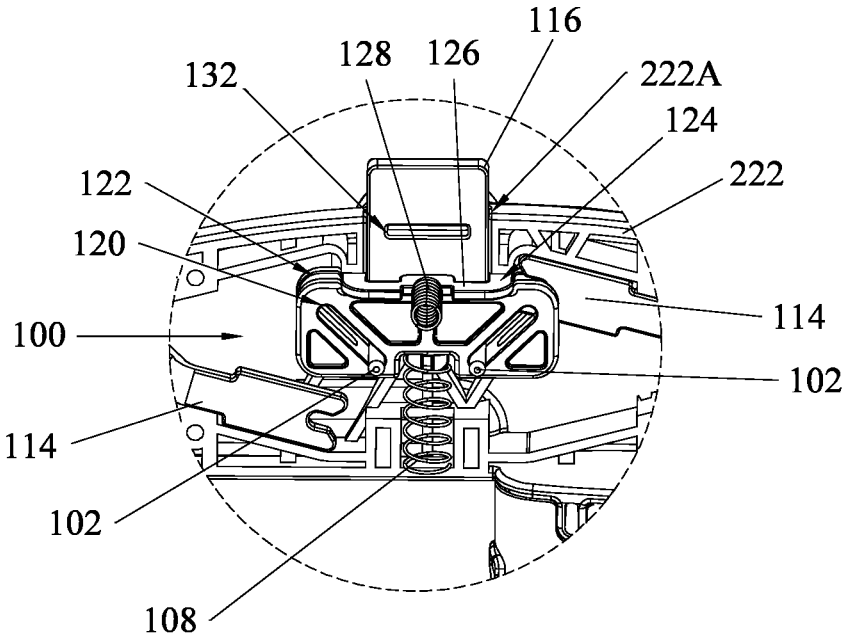
FIG. 8 is an enlarged view of portion C shown in FIG. 7.

FIGS. 5 and 6 are respectively a perspective view and an enlarged view illustrating a displacement of the bar extensions 114 as the child support frame 204 swings to one side. FIGS. 7 and 8 are respectively a perspective view and an enlarged view illustrating a displacement of the bar extensions 114 as the child support frame 204 swings to another side opposite to that shown in FIG. 5. As shown in FIGS. 5-8, the bar extensions 114 can alternately travel through the inner cavity 122 of the latch actuator 104 as the child support frame 204 swings back and forth.

Figure 9:
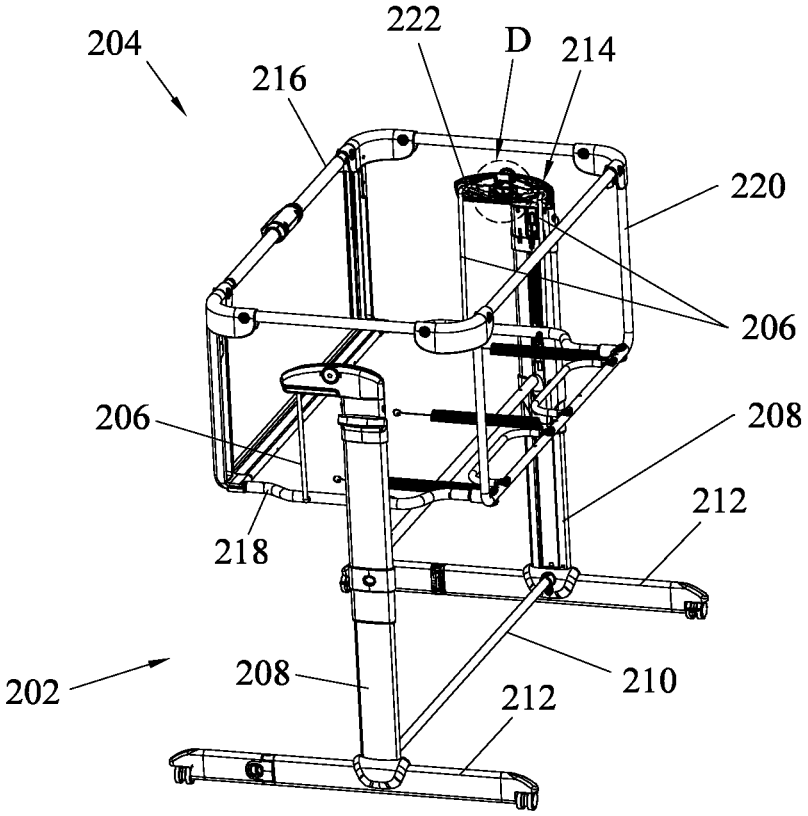
FIG. 9 is a perspective view illustrating the child care apparatus with the child support frame locked in a rest position.
Figure 10:
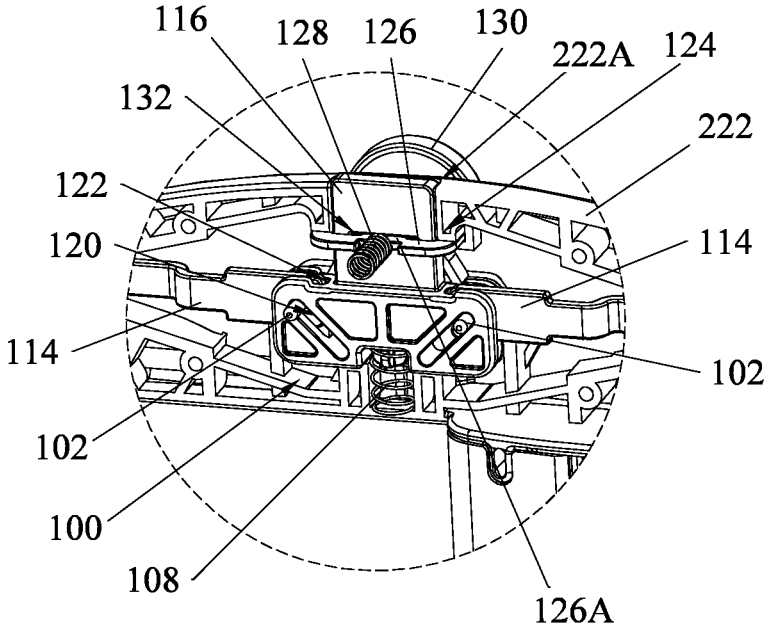
FIG. 10 is an enlarged view of portion D shown in FIG. 9.
Figure 11:
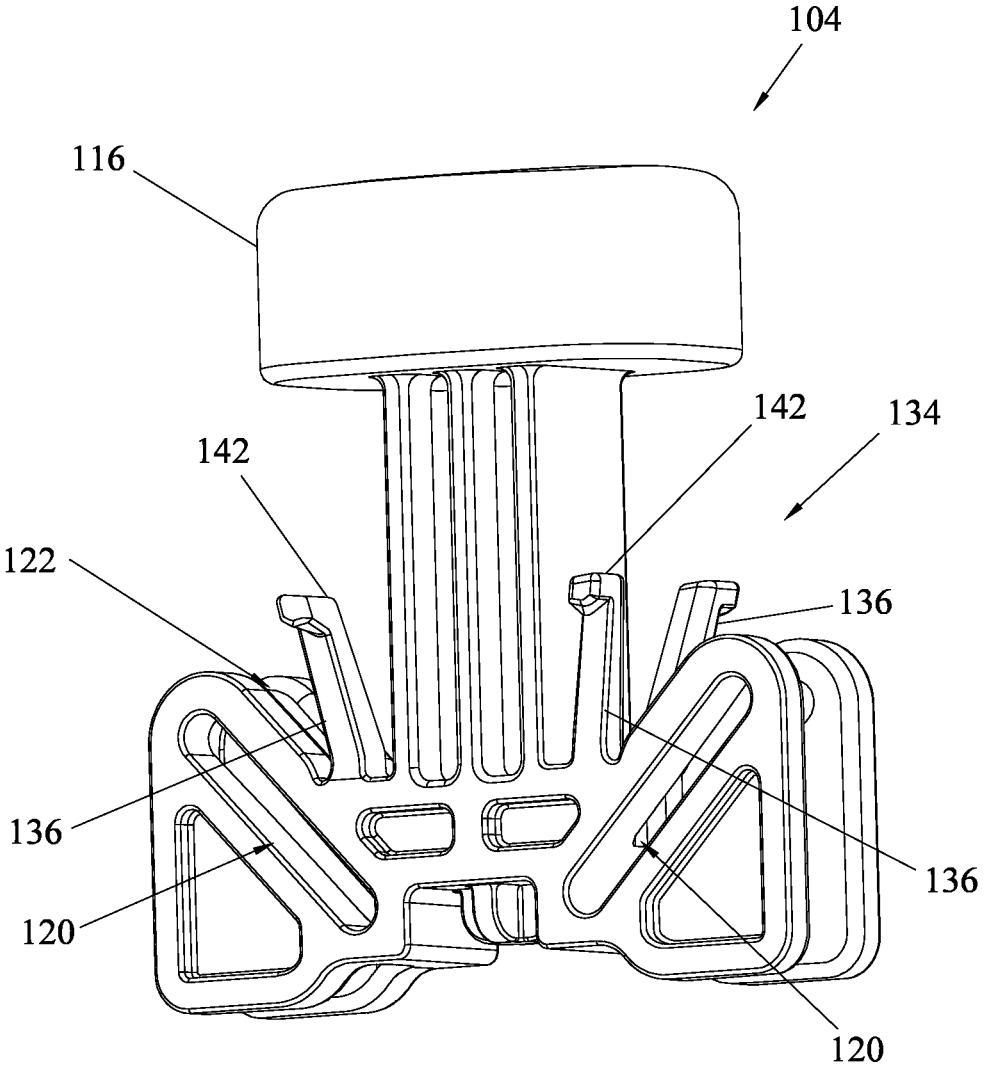
FIG. 11 is a perspective view illustrating another construction of a holding mechanism including detent parts provided on a latch actuator of the latching mechanism.
Figure 12:
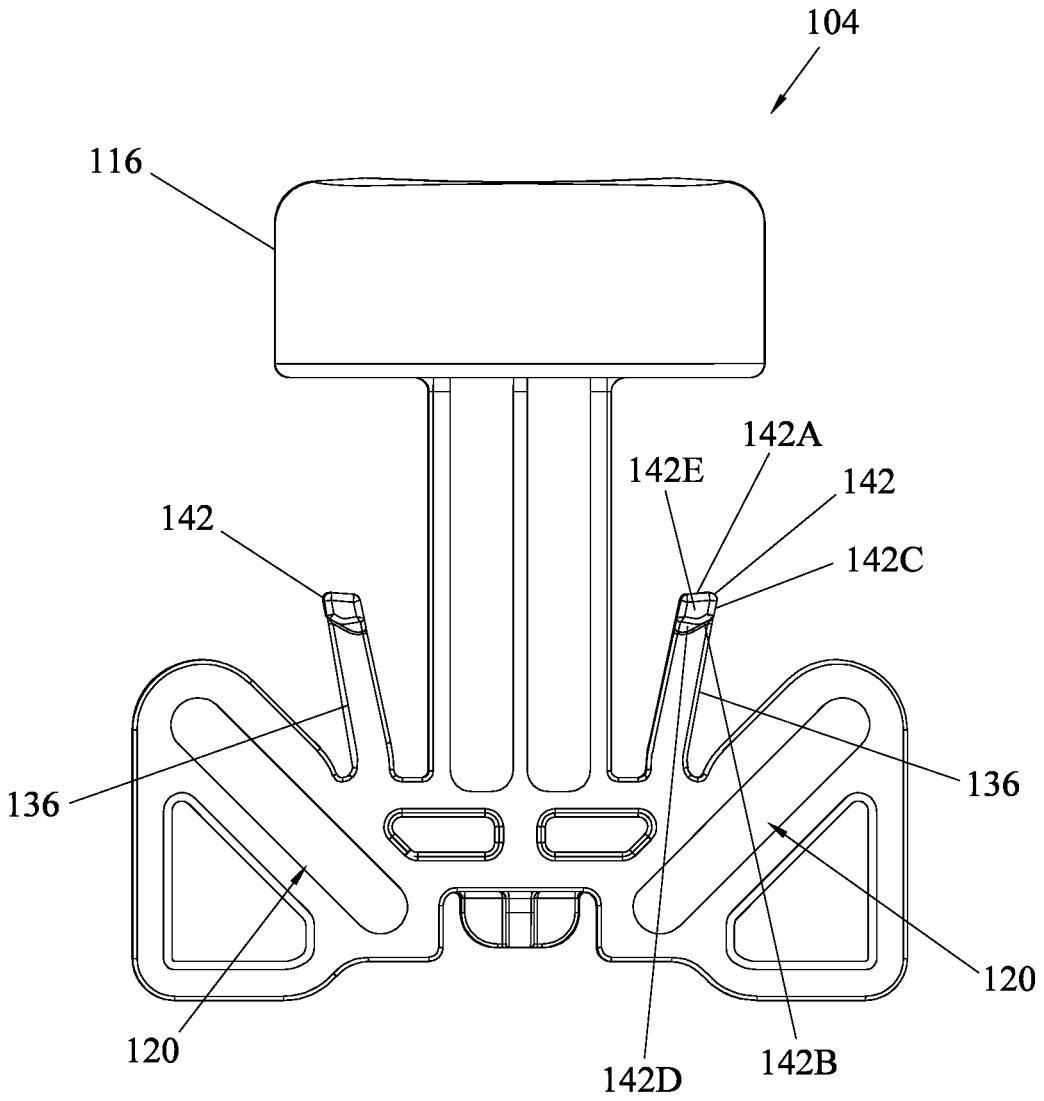
FIG. 12 is a front view of the latch actuator shown in FIG. 11.
Figure 13:
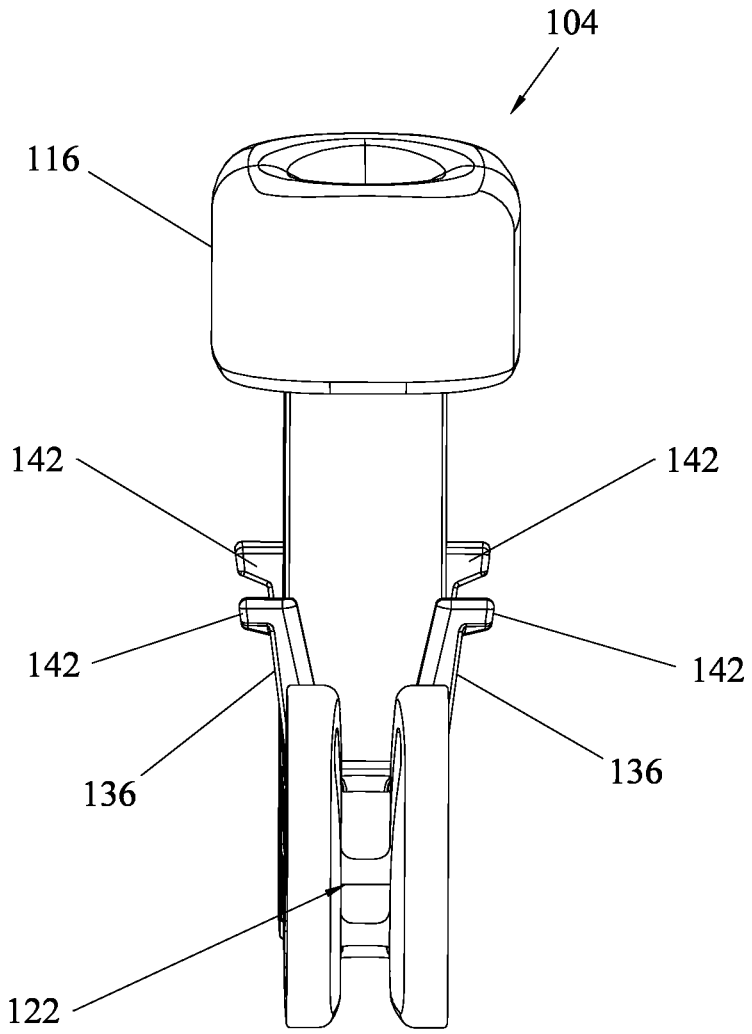
FIG. 13 is a side view of the latch actuator shown in FIG. 11.

Referring to FIGS. 9 and 10, when a caregiver wants to disable the swing motion, the child support frame 204 is first put in a proper rest position. For example, the proper rest position can be a lowest position of the child support frame 204 relative to the mounting portions 214 corresponding to a generally vertical position of the hanging bars 206. While the child support frame 204 remains in the proper rest position, a caregiver can press the operating portion 116 toward the interior of the mounting portion 214 so that the latch actuator 104 moves and urges the two latches 102 to move away from each other and respectively engage with the two bar extensions 114, thereby rotationally locking the hanging bars 206. As the latch actuator 104 moves toward the locking state, the opening 132 of the latch actuator 104 can be displaced toward the protrusion 126A of the locking part 126, which may be in sliding contact with the latch actuator 104, e.g., in sliding contact with the operating portion 116 of the latch actuator 104. Once the latch actuator 104 reaches the locking state, the spring 128 can urge the locking part 126 to lock the latch actuator 104 in position via an engagement of the protrusion 126A with the opening 132. The latching mechanism 100 can be thereby held in the locking state to prevent swinging of the child support frame 204.

To release the child support frame 204, a caregiver can press the release button 130 so that the locking part 126 moves and disengages from the latch actuator 104. Under the biasing force of the spring 108, the latch actuator 104 then can slide in a direction that causes the operating portion 116 to protrude outside the mounting portion 214, which displaces the opening 132 of the latch actuator 104 away from the protrusion 126A of the locking part 126 and urges the latches 102 to respectively disengage from the bar extensions 114 of the hanging bars 206. The hanging bars 206 are thereby unlocked and can rotate relative to the mounting portion 214 for swinging the child support frame 204.

In conjunction with FIGS. 1-10, FIGS. 11-14 are various views illustrating another construction of a holding mechanism 134 for keeping the latch actuator 104 and the latches 102 in the locking state, which can substitute for the holding mechanism 124 previously described. Referring to FIGS. 11-14, the latch actuator 104 can be connected and operate like previously described to drive locking and unlocking movements of the latches 102 shown in FIGS. 3 and 4, and the spring 108 shown in FIGS. 3 and 4 can be likewise used to bias the latch actuator 104 to the unlocking state. The holding mechanism 134 can include one or more detent part 136 (better shown in FIGS. 11-13) capable of elastic deformation that is connected with the latch actuator 104, and one or more anchoring part 138 (better shown in FIG. 14) having a notch 140 that is provided on the housing 222 of the mounting portion 214. The detent part 136 and the anchoring part 138 can be configured to interact with each other so that the detent part 136 can engage with the notch 140 for keeping the latch actuator 104 in the locking state and disengage from the notch 140 for releasing the latch actuator 104 in response to the application of an external force on the operating portion 116 of the latch actuator 104.

Referring to FIGS. 11-14, the detent part 136 is attached to the latch actuator 104, and is movable along with the latch actuator 104 between the unlocking state and the locking state. The detent part 136 can have a protrusion 142 that can be in sliding contact with the anchoring part 138. According to an example of construction, the detent part 136 can have an elongate shape, and the protrusion 142 can be provided at a distal end of the detent part 136. The protrusion 142 of the detent part 136 can engage with the notch 140 of the anchoring part 138 for holding the latch actuator 104 in the locking state, and disengage from the notch 140 for releasing the latch actuator 104 so that the latch actuator 104 can move from the locking state to the unlocking state. For example, the protrusion 142 can have an edge surface 142A that can contact against a sidewall surface 140A of the notch 140 to stop and hold the latch actuator 104 in the locking state. Moreover, the protrusion 142 of the detent part 136 can be in sliding contact and interact with the anchoring part 138 so as to cause elastic deflection of the detent part 136 for facilitating the engagement and disengagement of the protrusion 142 with respect to the notch 140. For example, the sliding contact may be achieved between the anchoring part 138 and any one of a plurality of edge regions 142B, 142C, 142D and 142E of the protrusion 142.

Figure 14:
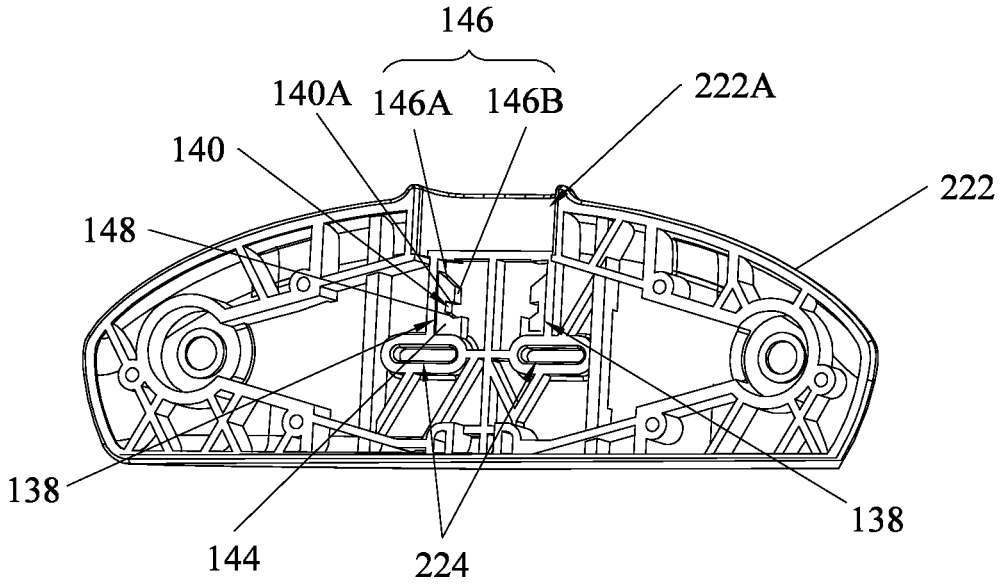
FIG. 14 is a perspective view illustrating another portion of the holding mechanism shown in FIG. 11 including an anchoring part provided on a housing of a mounting portion in the child care apparatus.

According to an example of construction, the anchoring part 138 can be fixedly connected with the housing 222. Referring to FIG. 14, the anchoring part 138 can have a base surface 144, and an edge 146 connected with the base surface 144. The notch 140 can be cut into the edge 146, and can open on the base surface 144. The edge 146 can include two edge surfaces 146A and 146B of different orientations that are connected with each other at an angle, the edge surface 146B being adjacent to the notch 140. Moreover, the anchoring part 138 can include an ejecting surface 148, which is provided inside the notch 140 opposite to the sidewall surface 140A of the notch 140 and is connected at an angle with the base surface 144. As the ejecting surface 148 extends away from the base surface 144, the ejecting surface 148 can bend toward the interior of the notch 140. According to an example of construction, the anchoring part 138 including the base surface 144, the edge 146 and the ejecting surface 148 may be formed integrally as one single body.

According to an embodiment, the holding mechanism 134 can include four detent parts 136 of a same construction provided on the latch actuator 104, and four corresponding anchoring parts 138 of a same construction provided in the housing 222. It will be appreciated, however, that the holding mechanism 134 is not limited to the aforementioned example and may include more or less detent parts 136 and anchoring parts 138.

Figure 15:
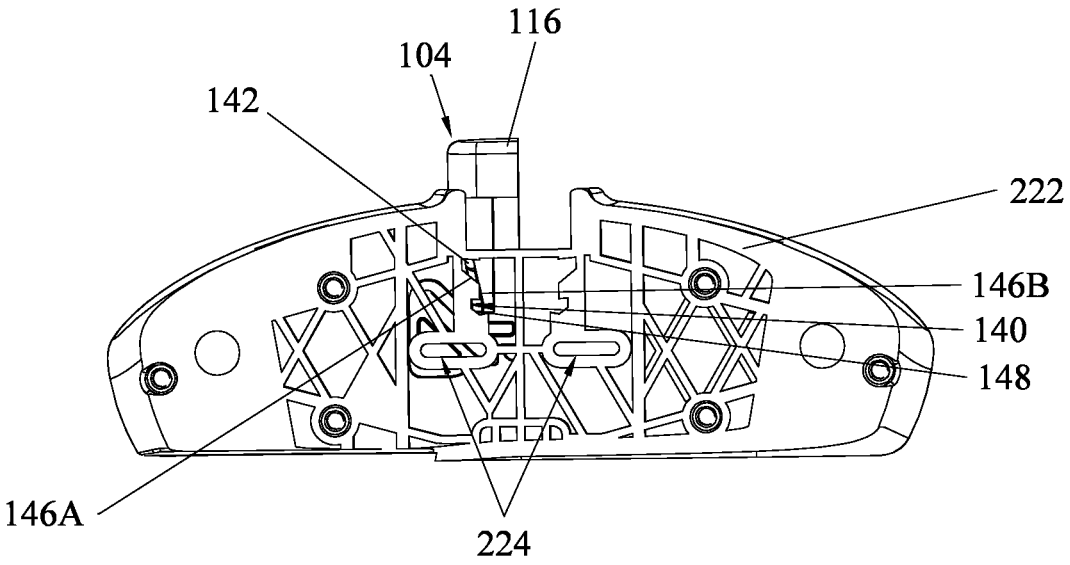
FIGS. 15-18 are schematic views illustrating exemplary operation of the holding mechanism shown in FIGS. 11-14 when the latching mechanism is switched from the unlocking state to the locking state.

In conjunction with FIGS. 1-3 and 11-14, FIGS. 15-20 are schematic views illustrating exemplary operation of the holding mechanism 134. Referring to FIG. 15, the holding mechanism 134 is shown in a configuration corresponding to the unlocking state of the latch actuator 104 with the operating portion 116 thereof protruding outside the housing 222. While the latch actuator 104 is in the unlocking state, the protrusion 142 of the detent part 136 is disengaged from the notch 140 and is located adjacent to the edge surface 146A of the anchoring part 138.

Figure 16:
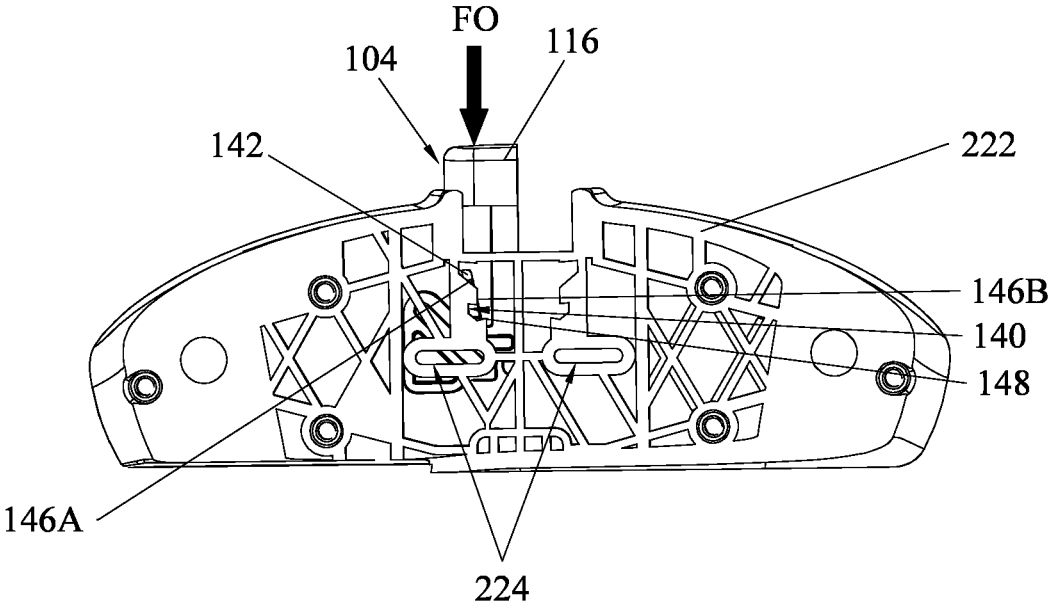
Figure 17:
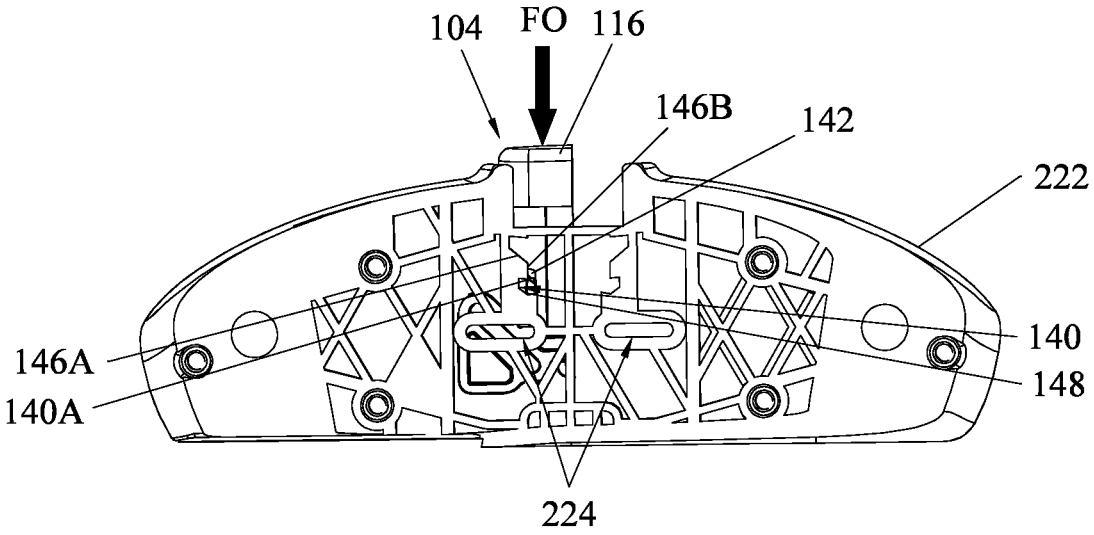
Figure 18:
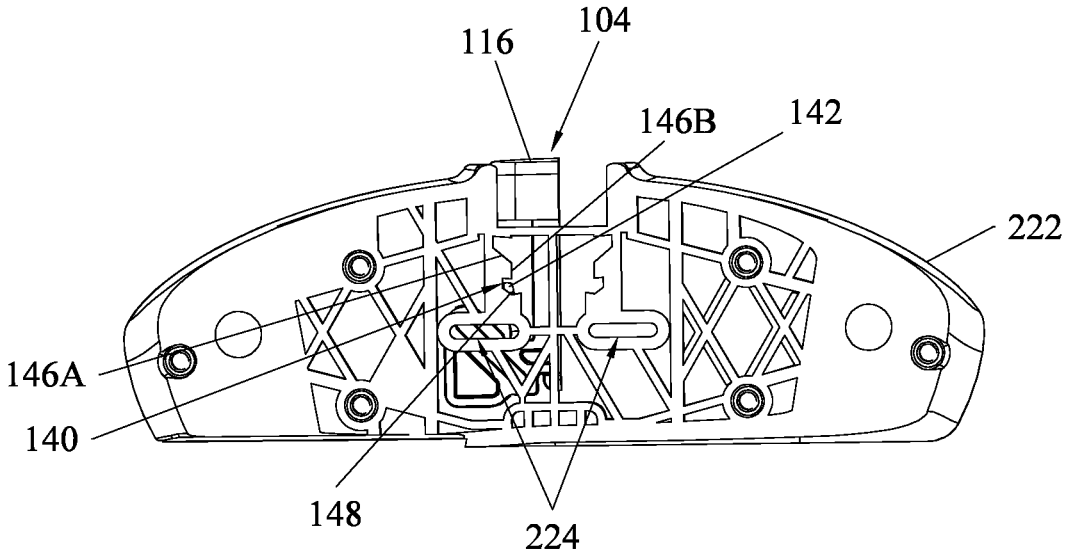

Referring to FIGS. 16-18, a caregiver can apply a force FO on the operating portion 116 of the latch actuator 104 for switching the latch actuator 104 from the unlocking state to the locking state. As the latch actuator 104 moves in a first direction from the unlocking state toward the locking state in response to the application of the force FO, the protrusion 142 of the detent part 136 can slide in contact with the edge 146 of the anchoring part 138 transitioning from the edge surface 146A to the edge surface 146B. For example, the protrusion 142 may contact with the edge surface 146A at the edge region 142B, and may contact with the edge surface 146B at the edge region 142C. This causes the detent part 136 to deflect, which elastically loads the detent part 136. When the protrusion 146 of the detent part 136 reaches the notch 140, the detent part 136 can release at least partially the elastic load and urge the protrusion 142 to engage with the notch 140. The engagement of the protrusion 146 with the notch 140 can position the edge surface 142A of the protrusion 142 adjacent to the sidewall surface 140A of the notch 140. The force FO then can be removed, and the edge surface 142A of the protrusion 142 can contact with the sidewall surface 140A of the notch 140 to keep the latch actuator 104 in the locking state against the biasing force of the spring 108 (better shown in FIGS. 3 and 4).

Figure 19:
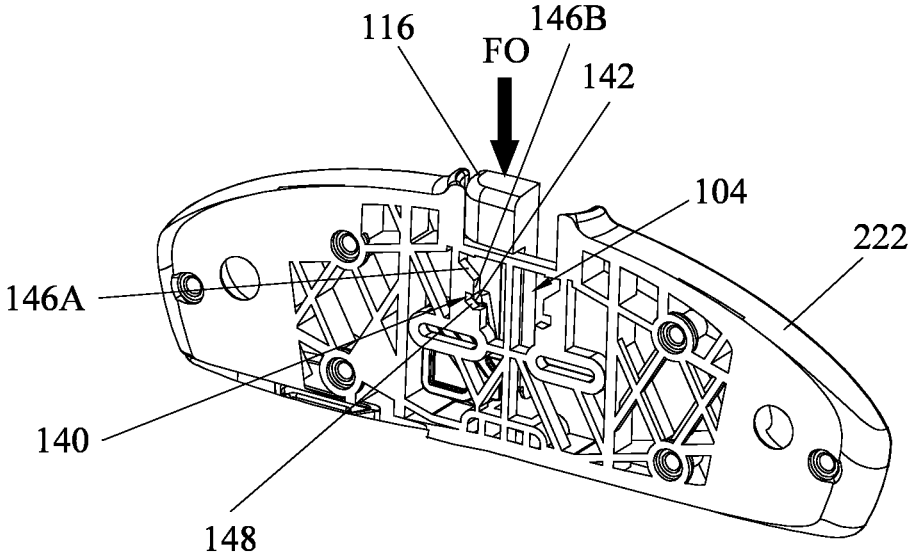
FIGS. 19 and 20 are schematic views illustrating exemplary operation of the holding mechanism shown in FIGS. 11-14 when the latching mechanism is switched from the locking state to the unlocking state.
Figure 20:
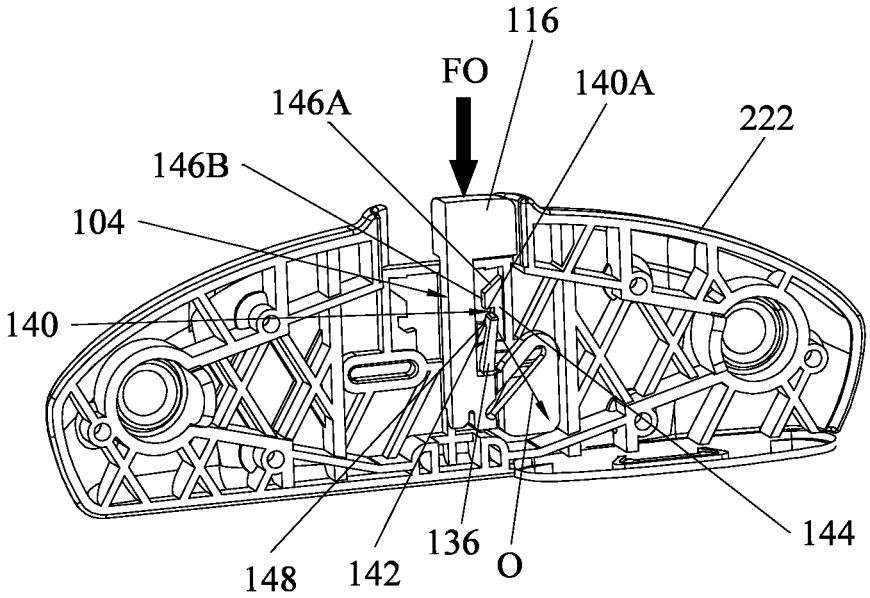

Referring to FIGS. 19 and 20, a caregiver can likewise apply a force FO on the operating portion 116 of the latch actuator 104 for switching the latch actuator 104 from the locking state to the unlocking state. As the latch actuator 104 moves in the first direction in response to the application of the force FO, the edge surface 142A of the protrusion 142 can be displaced away from the sidewall surface 140A of the notch 140, and the protrusion 142 can slide in contact with the ejecting surface 148 of the anchoring part 138. For example, the protrusion 142 may contact with the ejecting surface 148 at the edge region 142D. This causes the detent part 136 to deflect in a direction schematically illustrated with arrow O in FIG. 20, which can disengage the protrusion 142 from the notch 140 and elastically loads the detent part 136. Once the protrusion 142 has disengaged from the notch 140, the protrusion 142 can be in sliding contact with the base surface 144 of the anchoring part 138, and the detent part 136 can release at least partially the elastic load and displace the protrusion 142 sideways away from the notch 140. The force FO then can be removed, and the biasing force of the spring 108 (better shown in FIGS. 3 and 4) can urge the latch actuator 104 to move in a second direction opposite to the first direction toward the unlocking state. As the latch actuator 104 moves toward the unlocking state, the protrusion 142 can slide in contact with the base surface 144 past the notch 140 and the edge surface 146B of the anchoring part 138. Once the latch actuator 104 reaches the unlocking state, the protrusion 142 is positioned adjacent to the edge surface 146A of the anchoring part 138, and the operating portion 116 protrudes outside the housing 222.

Figure 21:
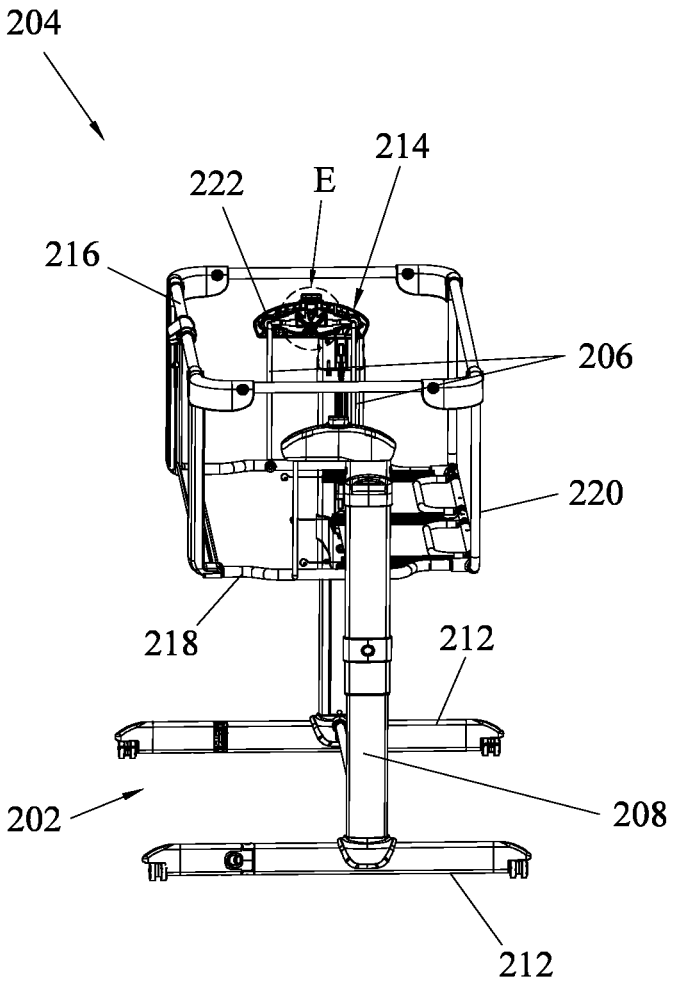
FIG. 21 is a perspective view illustrating the child care apparatus provided with another construction of a holding mechanism for keeping the latching mechanism in a locking state.
Figure 22:
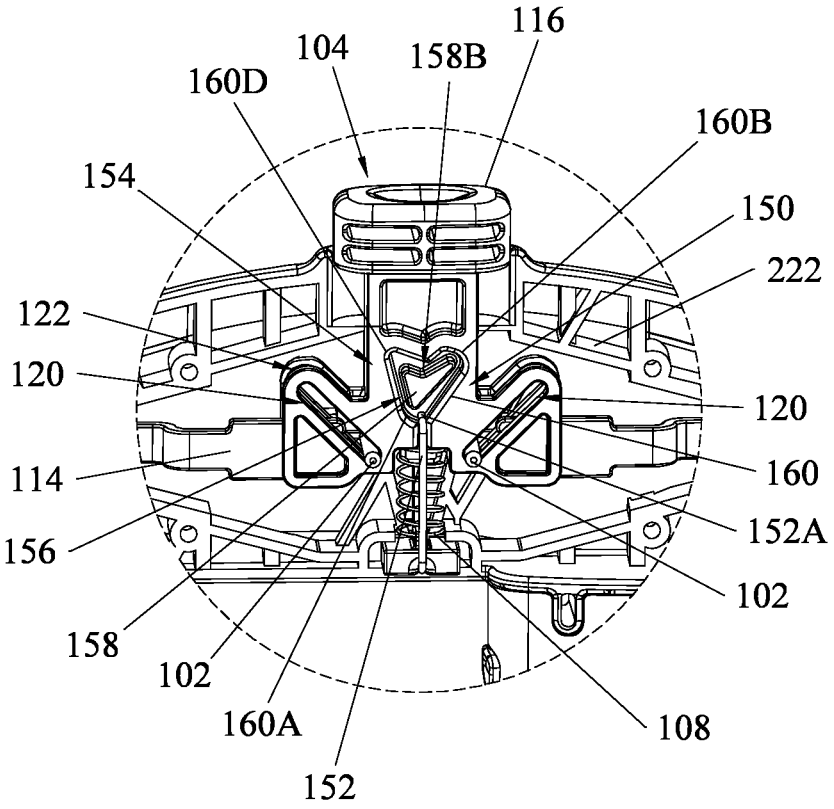
FIG. 22 is an enlarged view of portion E shown in FIG. 21.
Figure 23:
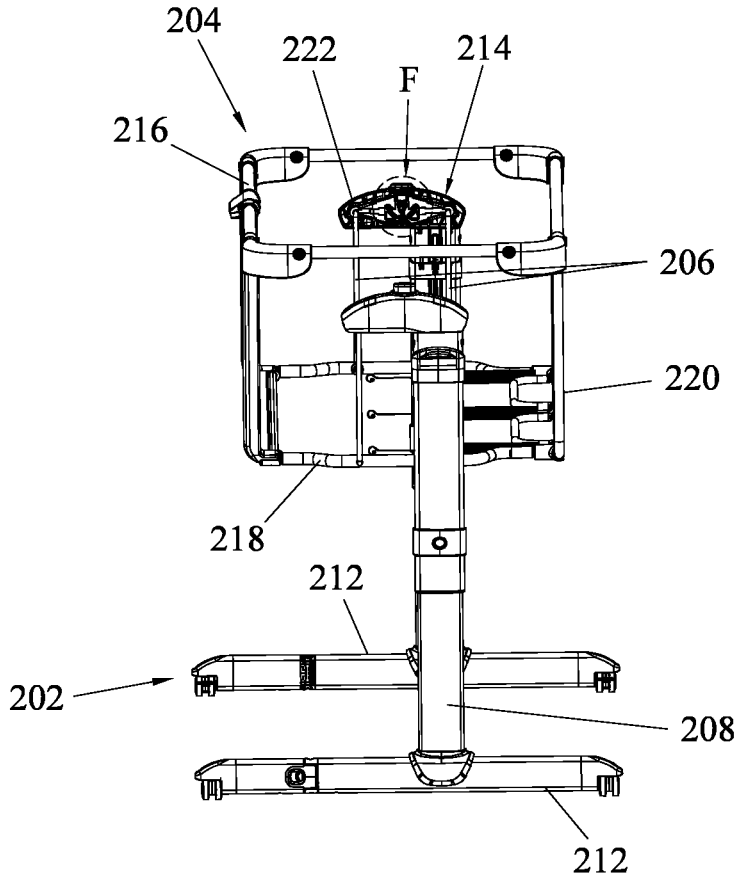
FIG. 23 is a perspective view of the child care apparatus shown in FIG. 21 with the holding mechanism being in an intermediate stage as the latching mechanism is switched from the unlocking state toward the locking state.

FIGS. 21 and 22 are respectively a perspective view and an enlarged view illustrating another construction of a holding mechanism 150 for keeping the latch actuator 104 and the latches 102 in the locking state, which can substitute for the holding mechanisms previously described. Referring to FIGS. 21 and 22, the latch actuator 104 can be connected and operate like previously described to drive locking and unlocking movements of the latches 102, and the spring 108 can be provided to bias the latch actuator 104 to the unlocking state. The holding mechanism 150 can include a detent part 152 connected with the housing 222, and an anchoring part 154 having a closed guide track 156 and a protuberance 158 provided on the latch actuator 104. The detent part 152 and the anchoring part 154 can be configured to interact with each other so that the detent part 152 can engage with the protuberance 158 for keeping the latch actuator 104 in the locking state and disengage from the protuberance 158 for releasing the latch actuator 104 in response to the application of an external force on the operating portion 116 of the latch actuator 104.

Referring to FIGS. 21 and 22, the detent part 152 can be pivotally connected with the housing 222, and is rotatable relative to the housing 222 as the latch actuator 104 moves between the unlocking state and the locking state. According to an example of construction, the detent part 152 can include a rod pivotally connected with the housing 222. The detent part 152 can have a protrusion 152A that is received in the guide track 156. During operation, the protrusion 152A can be guided for sliding along the guide track 156, and the detent part 152 can rotate relative to the housing 222.

The anchoring part 154 comprised of the guide track 156 and the protuberance 158 is carried with the latch actuator 104. The guide track 156 can extend around the protuberance 158. More specifically, the guide track 156 can be defined between the protuberance 158 and an outer sidewall 160 surrounding the protuberance 158. The protuberance 158 and the outer sidewall 160 can be fixedly connected with the latch actuator 104. For example, the protuberance 158 and the outer sidewall 160 may be formed integrally with the latch actuator 104. The protuberance 158 and the outer sidewall 160 can generally have a heart-like shape, and can be in sliding contact with the protrusion 152A of the detent part 152 during operation.

In conjunction with FIGS. 21 and 22, FIGS. 23-32 are schematic views illustrating exemplary operation of the holding mechanism 150. Referring to FIGS. 21 and 22, the holding mechanism 150 is shown in a configuration corresponding to the unlocking state of the latch actuator 104 with the operating portion 116 thereof protruding outside the housing 222. While the latch actuator 104 is in the unlocking state, the protrusion 152A of the detent part 152 can contact with a concavity 160A provided in the outer sidewall 160.

Figure 24:
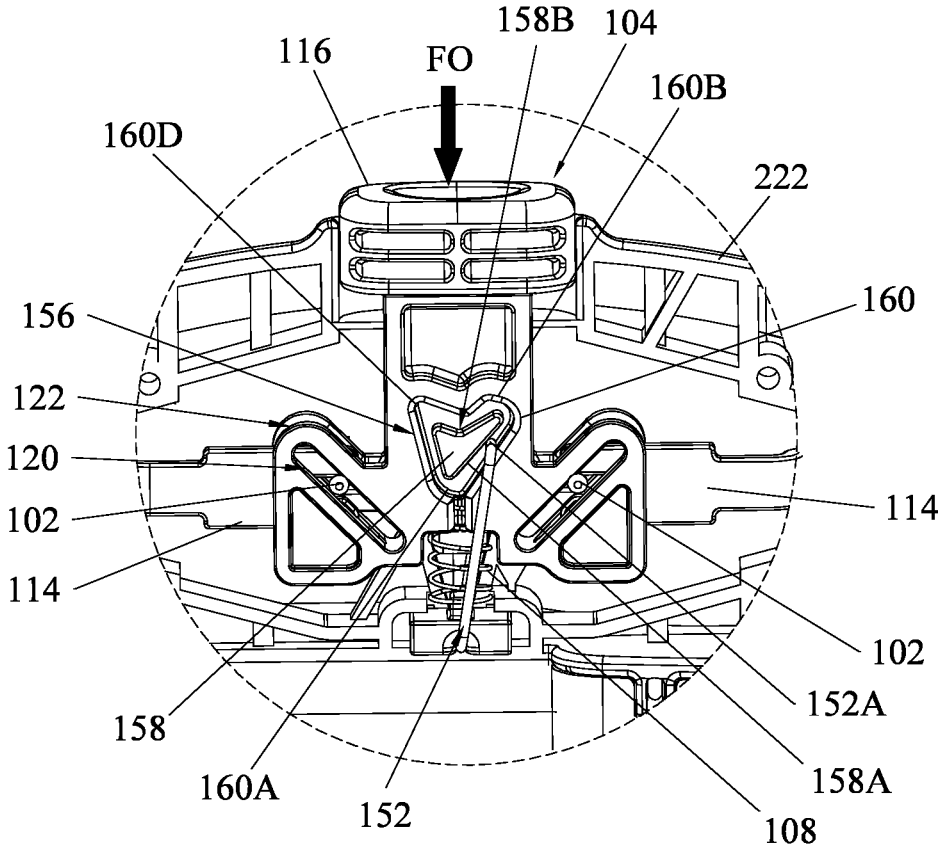
FIG. 24 is an enlarged view of portion F shown in FIG. 23.
Figure 25:
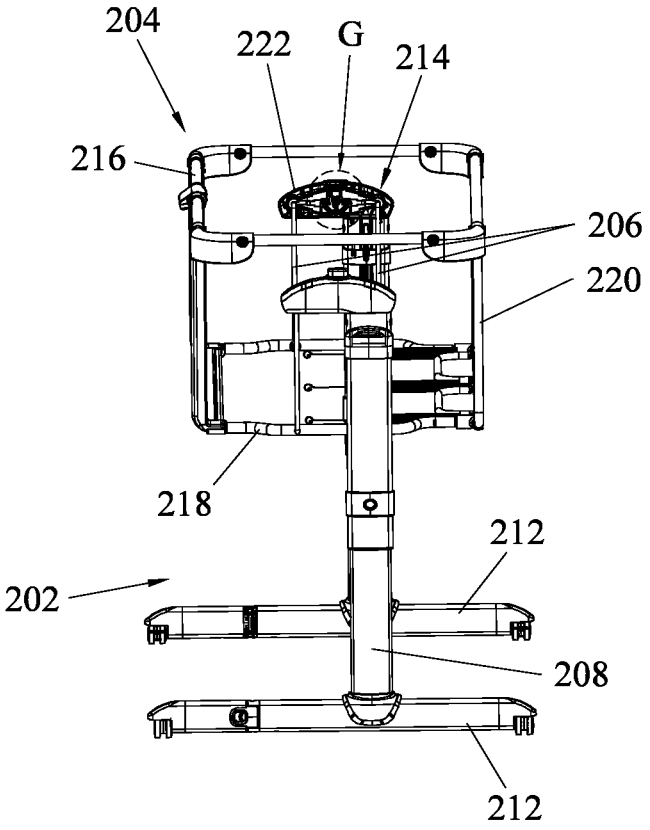
FIG. 25 is a perspective view of the child care apparatus shown in FIG. 21 with the holding mechanism being in another intermediate stage following that shown in FIGS. 23 and 24 as the latching mechanism is switched from the unlocking state toward the locking state.
Figure 26:
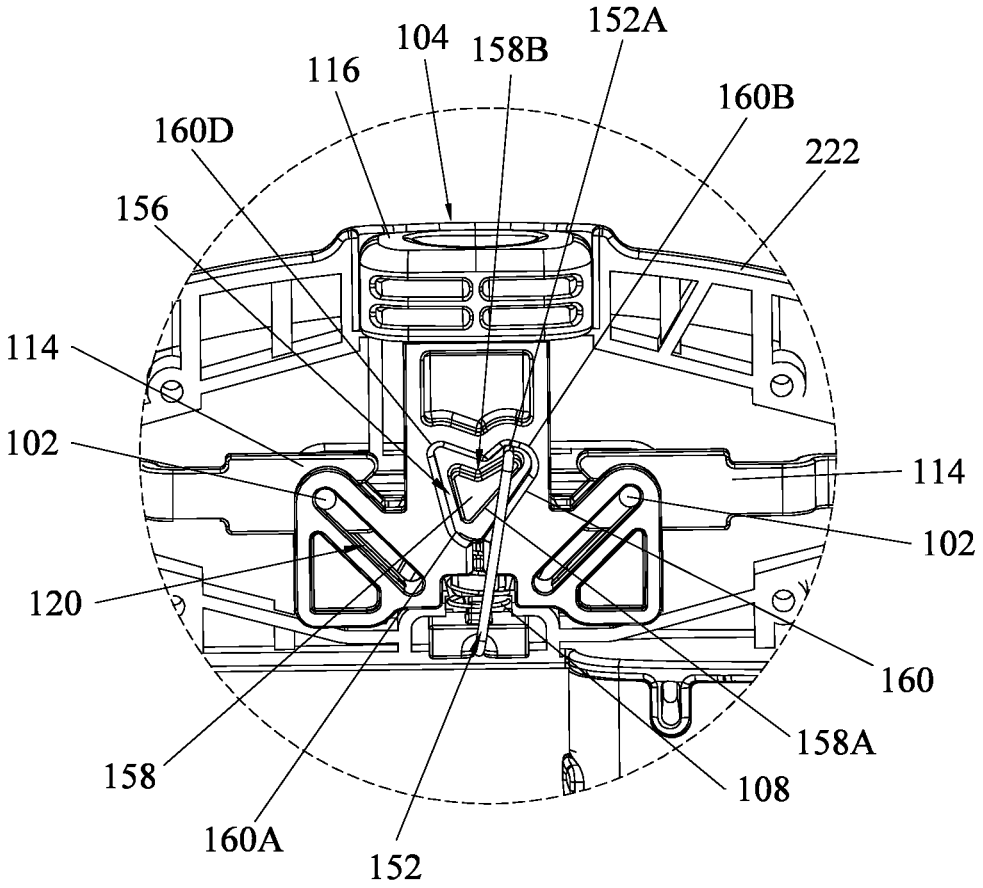
FIG. 26 is an enlarged view of portion G shown in FIG. 25.

Referring to FIGS. 23-26, a caregiver can apply a force FO on the operating portion 116 of the latch actuator 104 for switching the latch actuator 104 from the unlocking state to the locking state. As the latch actuator 104 moves in a first direction from the unlocking state toward the locking state in response to the application of the force FO, the protrusion 152A of the detent part 152 can be displaced along the guide track 156 in sliding contact with an edge 158A of the protuberance 158, which can cause a rotational movement of the detent part 152 relative to the housing 222. This is schematically shown in FIG. 24. The protrusion 152A of the detent part 152 can slide in contact with the edge 158A of the protuberance 158 until it reaches a turn portion 160B of the outer sidewall 160 as shown in FIG. 26, which can prevent the latch actuator 104 from further moving in the first direction. Accordingly, the force FO can be removed.

Figure 27:
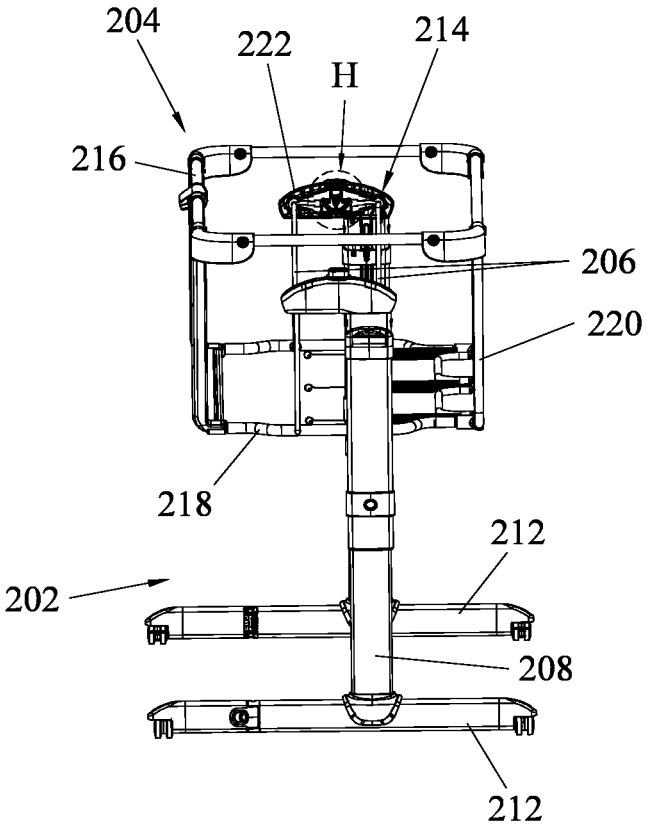
FIG. 27 is a perspective view of the child care apparatus shown in FIG. 21 with the holding mechanism being in a configuration that keeps the latching mechanism in the locking state.
Figure 28:
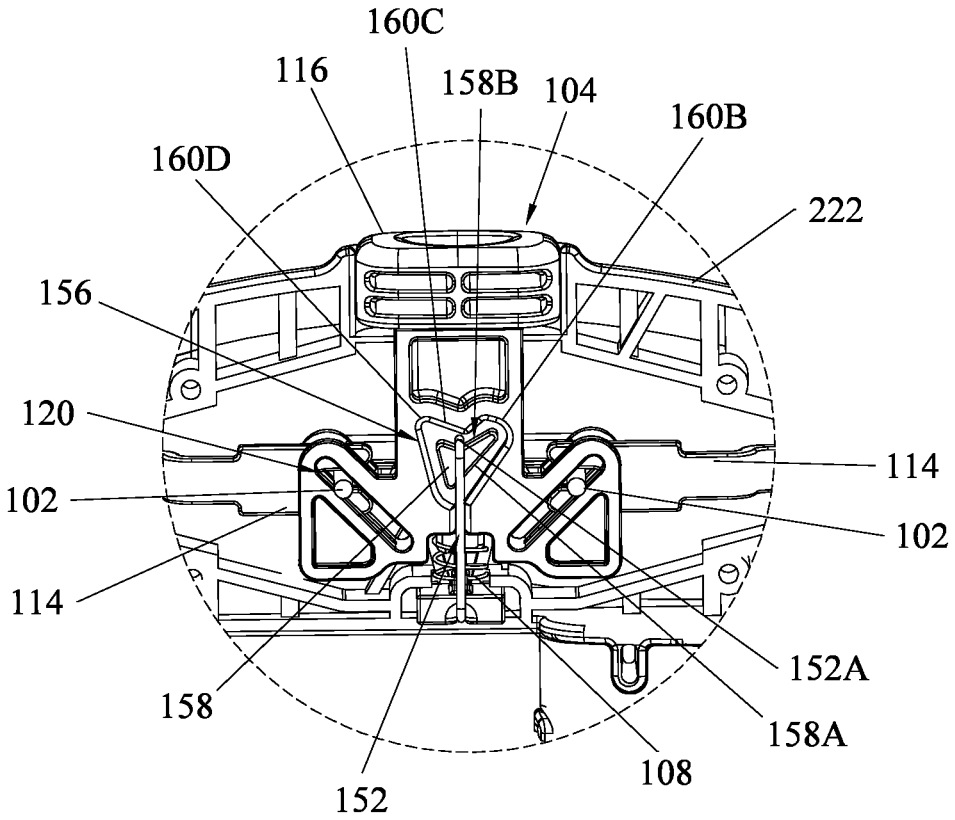
FIG. 28 is an enlarged view of portion H shown in FIG. 27.
Figure 29:
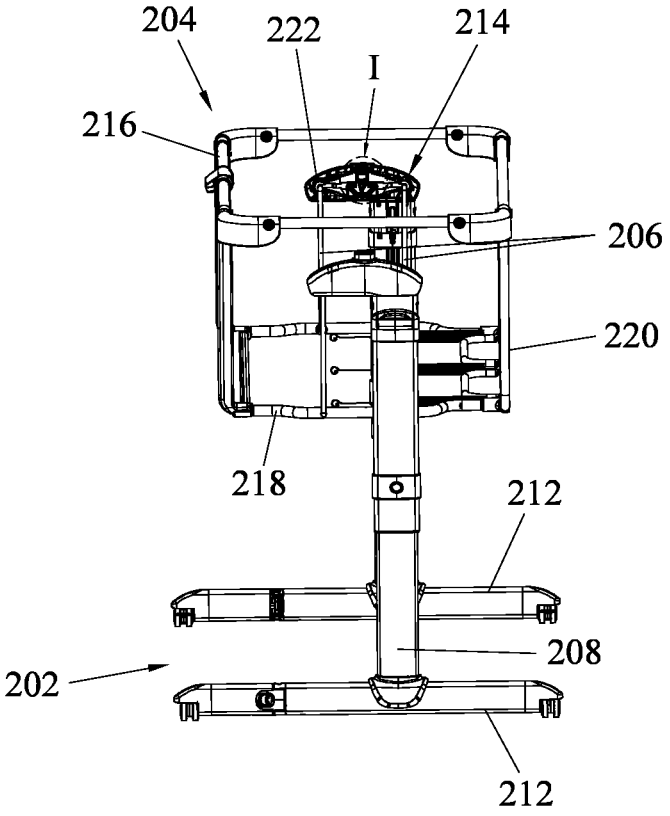
FIG. 29 is a perspective view of the child care apparatus shown in FIG. 21 with the holding mechanism being in another intermediate stage as the latching mechanism is switched from the locking state toward the unlocking state.

Referring to FIGS. 27 and 28, as the force FO is removed while the protrusion 152A of the detent part 152 is located at the turn portion 160B of the outer sidewall 160, the spring 108 can urge the latch actuator 104 to move in a second direction opposite to the first direction, which causes the protrusion 152A of the detent part 152 to move away from the turn portion 160B of the outer sidewall 160 and engage with a concavity 158B of the protuberance 158. The engagement of the protrusion 152A with the concavity 158B can prevent the latch actuator 104 to further move in the second direction, which can thereby keep the latch actuator 104 in the locking state against the biasing force of the spring 108.

Figure 30:
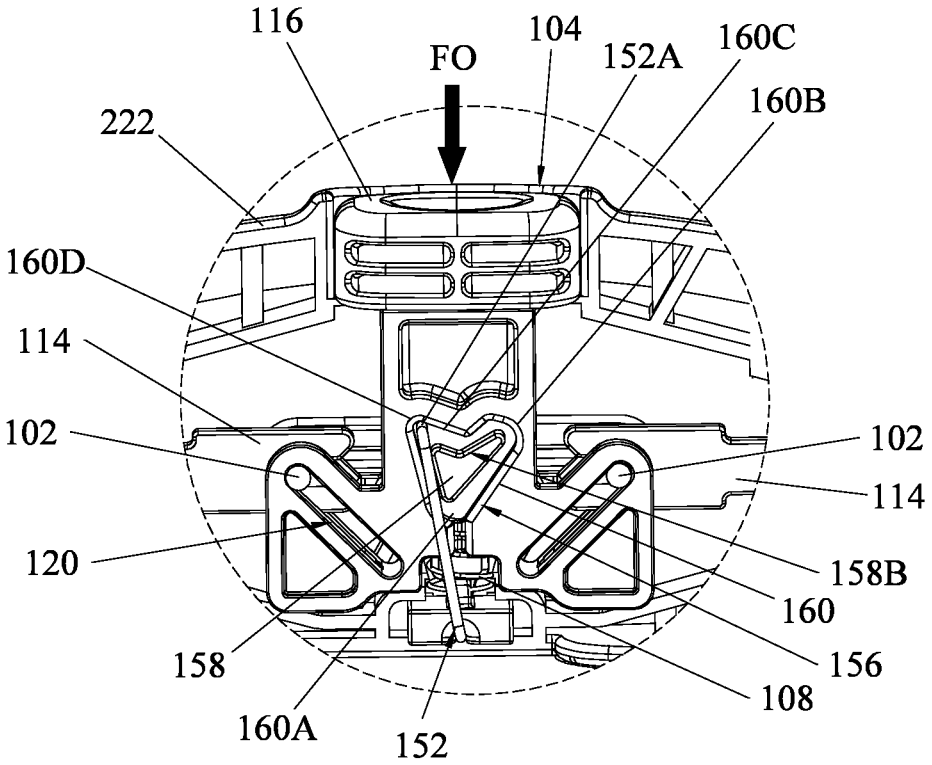
FIG. 30 is an enlarged view of portion I shown in FIG. 29.
Figure 31:
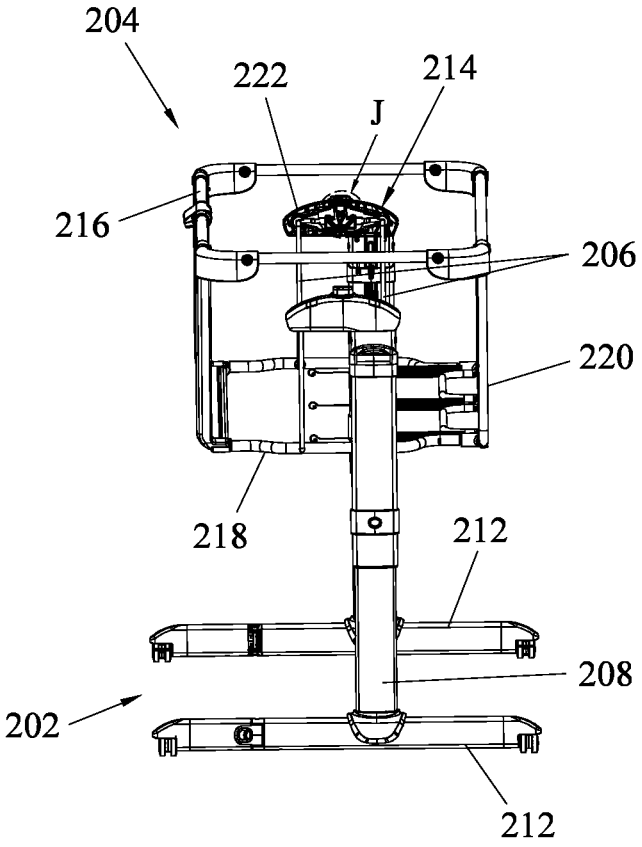
FIG. 31 is a perspective view illustrating the child care apparatus shown in FIG. 21 with the holding mechanism being in another intermediate stage following that shown in FIGS. 29 and 30 as the latching mechanism is switched from the locking state toward the unlocking state.

Referring to FIGS. 29-32, a caregiver can likewise apply a force FO on the operating portion 116 of the latch actuator 104 for switching the latch actuator 104 from the locking state to the unlocking state. As the latch actuator 104 moves in the first direction in response to the application of the force FO, the protrusion 152A of the detent part 152 can move in sliding contact with a ramp 160C of the outer sidewall 160 until the protrusion 152A reaches another turn portion 160D of the outer sidewall 160 for disengaging from the concavity 158B of the protuberance 158. When the protrusion 152A reaches the turn portion 160D of the outer sidewall 160 as shown in FIG. 30, the latch actuator 104 is prevented from further moving in the first direction. Accordingly, the force FO can be removed.

Figure 32:
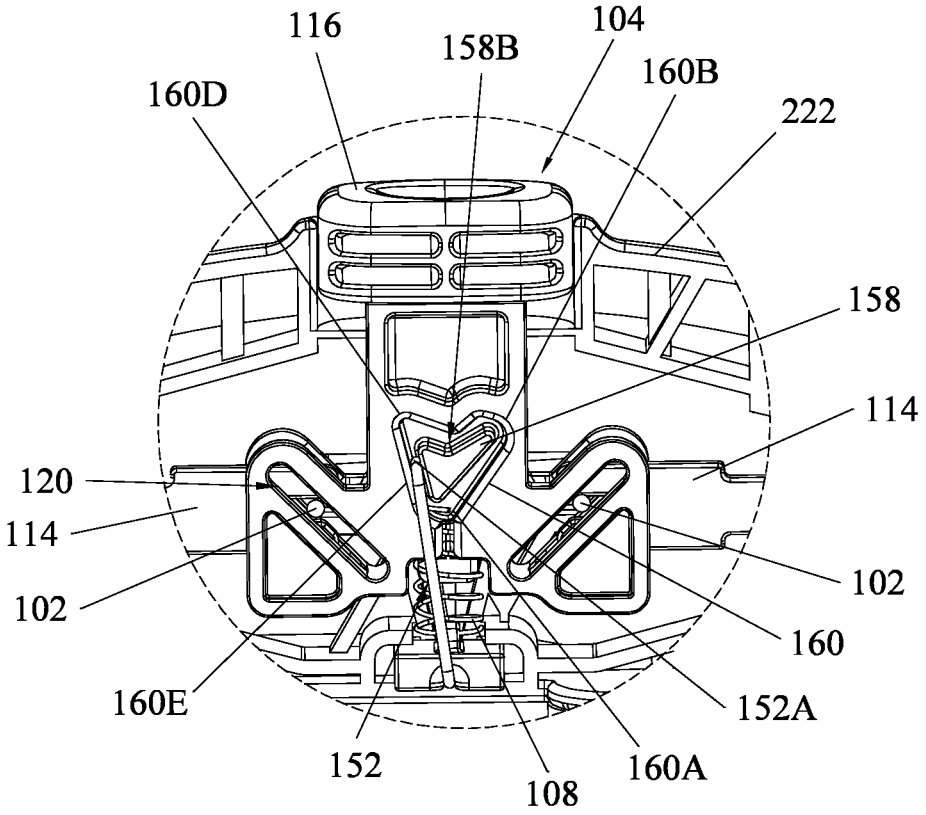
FIG. 32 is an enlarged view of portion J shown in FIG. 31.
Figure 33:
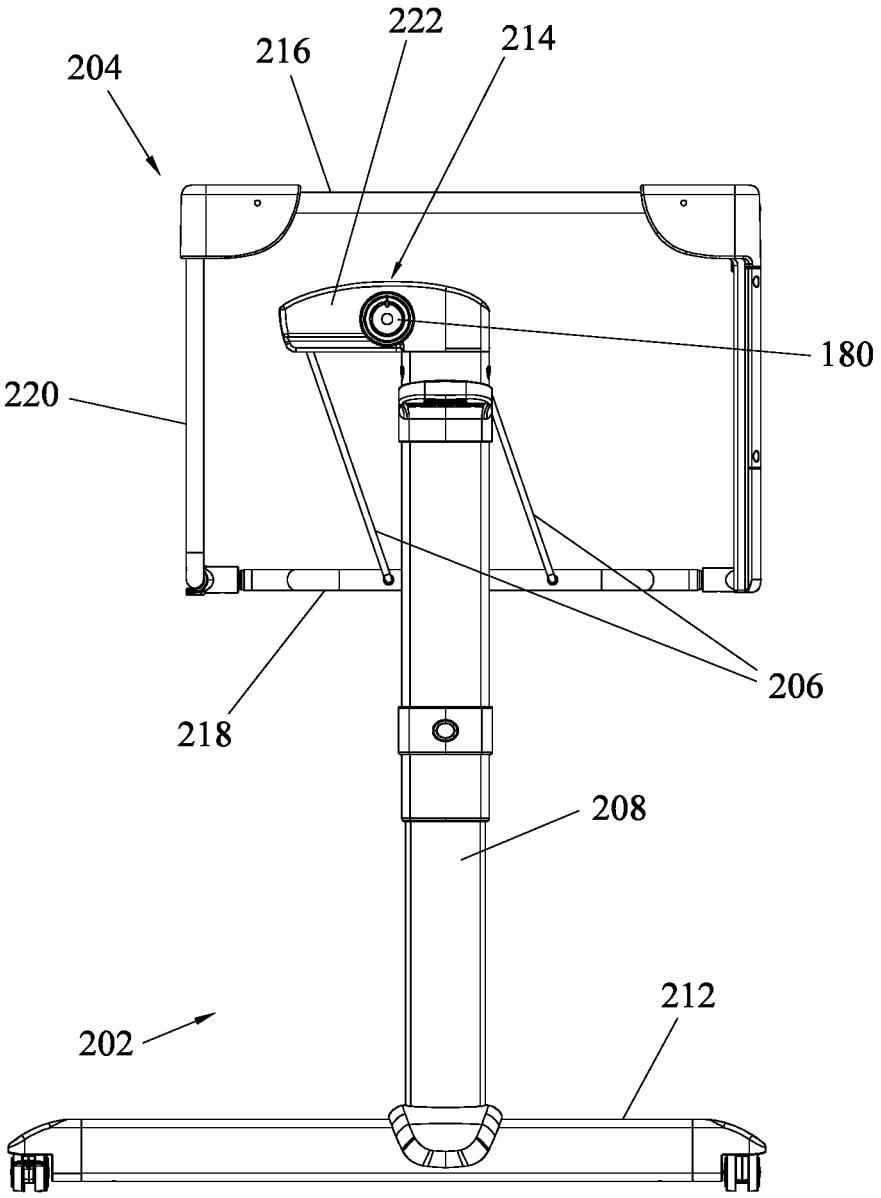
FIG. 33 is a side view illustrating the child care apparatus provided with another construction of a latching mechanism for preventing swinging of the child support frame.
Figure 34:
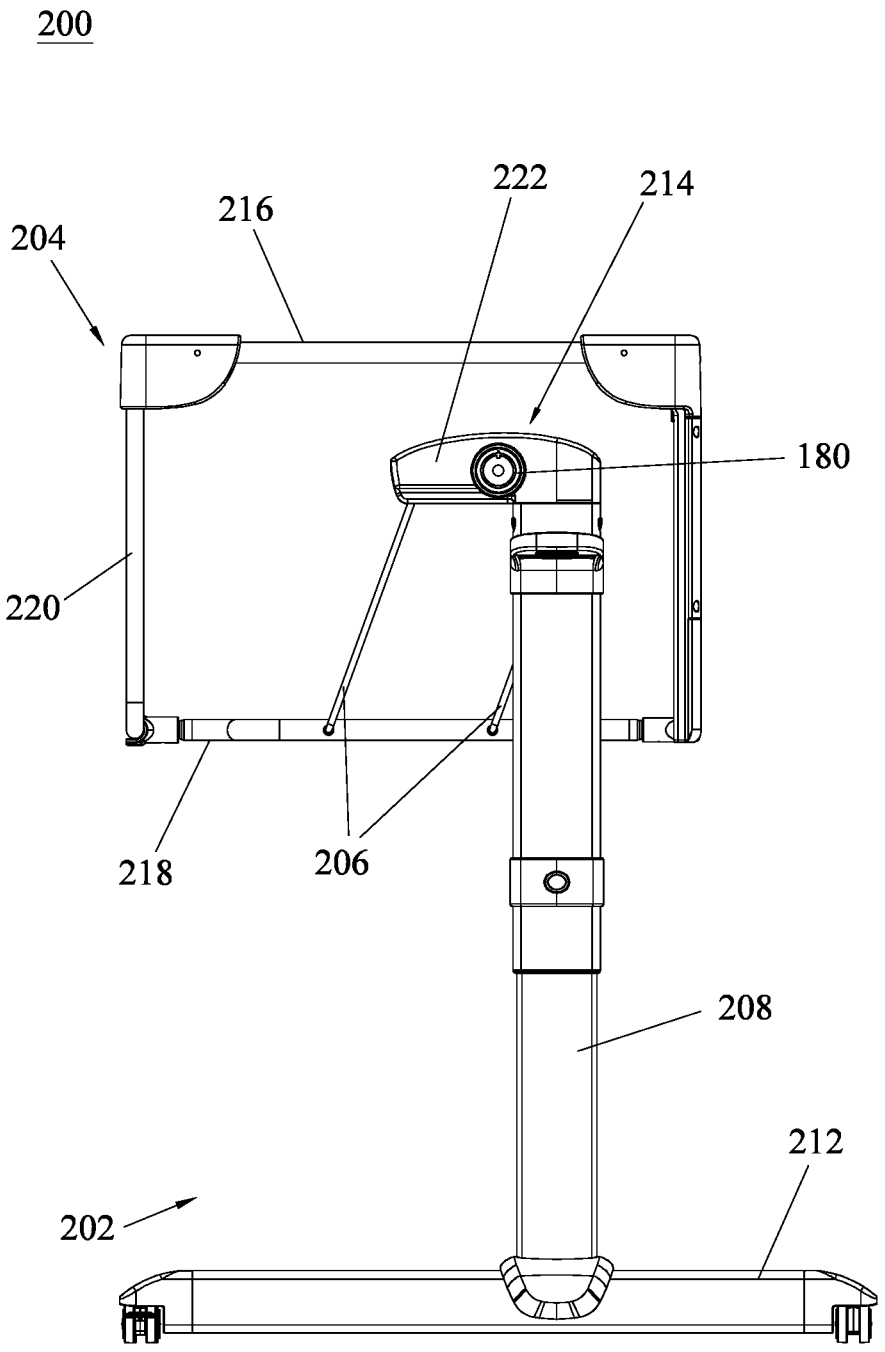
FIG. 34 is a side view illustrating the child care apparatus of FIG. 33 with the child support frame swung to another side.
Figure 35:
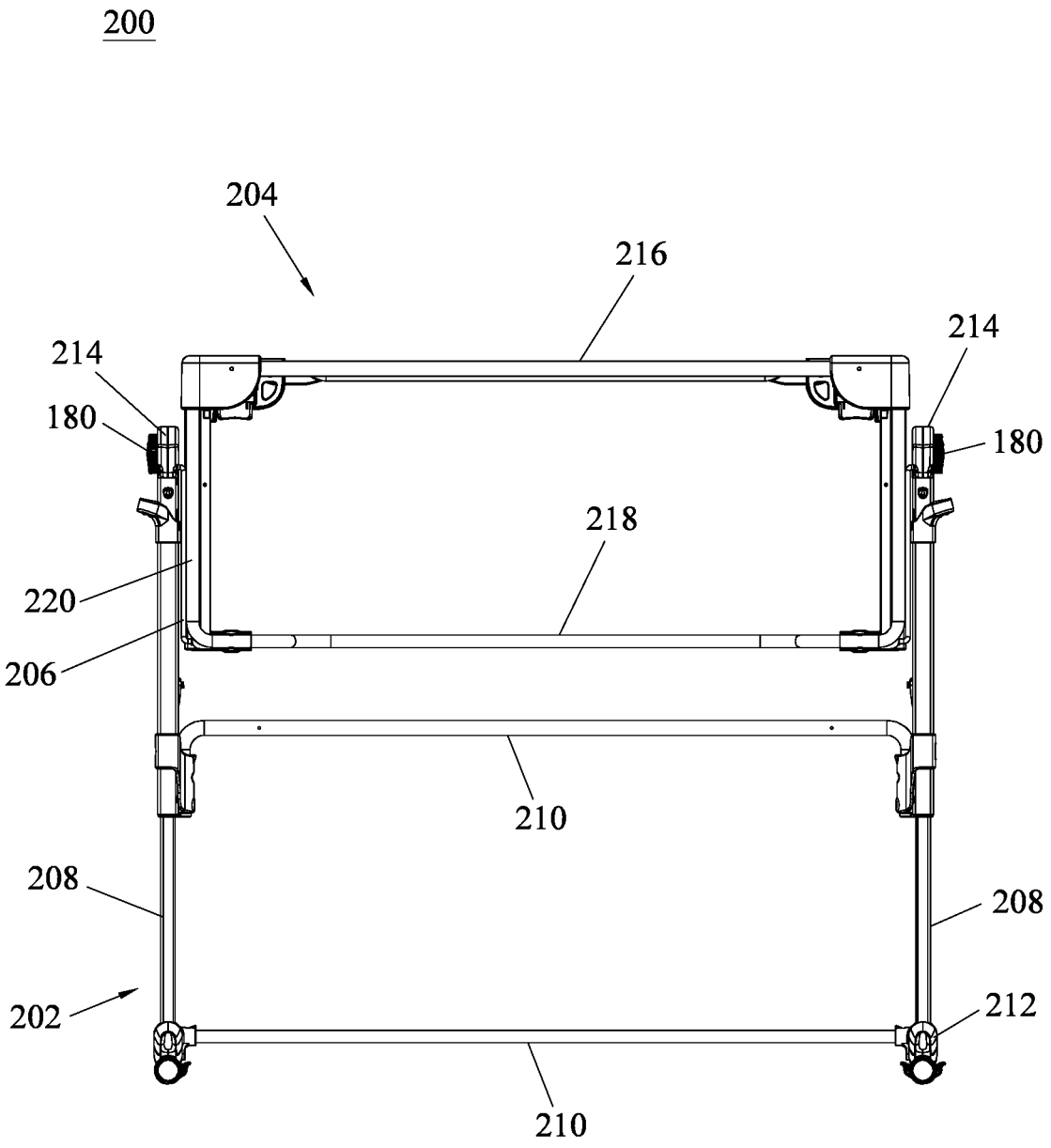
FIG. 35 is a front view of the child care apparatus shown in FIG. 33.

Referring to FIG. 32, as the force FO is removed while the protrusion 152A of the detent part 152 is located at the turn portion 160D of the outer sidewall 160, the spring 108 can urge the latch actuator 104 to move in the second direction opposite to the first direction until the latch actuator 104 reaches the unlocking state. As the latch actuator 104 moves in the second direction under the biasing force of the spring 108, the protrusion 152A of the detent part 152 can be displaced away from the turn portion 160D and move along the guide track 156 toward the concavity 160A at least in sliding contact with a ramp 160E of the outer sidewall 160. The protrusion 152A of the detent part 152 can be located adjacent to the concavity 160A of the outer sidewall 160 when the latch actuator 104 reaches the unlocking state.

FIGS. 33-37 are various views illustrating another construction of a latching mechanism 170 provided in the child care apparatus 200, which can substitute for the latching mechanism 100 previously described. Referring to FIGS. 33-37, the latching mechanism 170 can be likewise disposed adjacent to the mounting portion 214 of one support leg 208, and is operable to engage and lock the two hanging bars 206 that are pivotally connected with the mounting portion 214 of the same support leg 208. According to an example of construction, two of the same latching mechanism 170 may be respectively provided on the mounting portions 214 of the two support legs 208.

Referring to FIGS. 33-37, the latching mechanism 170 can include two latches 172 and a latch actuator 174, which can be assembled with the housing 222 of the mounting portion 214.

The two latches 172 can be connected with the housing 222 so as to operate in a symmetric manner. For example, the two latches 172 can move relative to the housing 222 away from each other to engage and rotationally lock the two hanging bars 206, and can move toward each other to disengage and rotationally unlock the two hanging bars 206. According to an example of construction, the two latches 172 can be slidably connected with the housing 222, whereby the two latches 172 can slide toward each other to disengage and rotationally unlock the two hanging bars 206 and can slide away from each other to engage and rotationally lock the two hanging bars 206. For example, the housing 222 may include two elongate slots 234, and the two latches 172 can be respectively guided for sliding through the two elongate slots 234. The elongate slots 234 can generally extend horizontally. The two latches 172 can thereby slide along an axis 176 that can be substantially orthogonal to the respective pivot axes of the hanging bars 206.

For facilitating the respective engagement of the two latches 172 with the two hanging bars 206, the two hanging bars 206 can respectively have two bar extensions 178 that extend into the housing 222. According to an example of construction, the two bar extensions 178 can be respectively attached fixedly to the upper portions 206A of the two hanging bars 206. According to another example of construction, the bar extensions 178 may be respectively formed integrally with the hanging bars 206. The two latches 172 can respectively engage with the two bar extensions 178 to rotationally lock the two hanging bars 206.

Referring to FIGS. 33-37, the latch actuator 174 is movably linked to the two latches 172, and is operable to cause the two latches 172 to concurrently move for rotationally locking and unlocking the two hanging bars 206. For example, the latch actuator 174 can move in a direction to urge the two latches 172 to concurrently move toward each other for disengaging and rotationally unlocking the two hanging bars 206, and can move in an opposite direction to urge the two latches 172 to concurrently move away from each other for engaging and rotationally locking the two hanging bars 206.

The latch actuator 174 can be a single part having an operating portion 180, can be pivotally connected with the housing 222 about a pivot axis 182 that is substantially orthogonal to the axis 176 and parallel to the pivot axes of the hanging bars 206, and can be connected pivotally and slidably with each of the two latches 172. According to an example of construction, each latch 172 can have two portions 172A and 172B that form an L-shape, the portion 172A can be slidably connected with the elongate slot 234 of the housing 222, and the portion 172B can be connected pivotally and slidably with the latch actuator 174. More specifically, the portion 172B of each latch 172 can have a guide slot 184 that extends generally orthogonal to the axis 176, and the latch actuator 174 can be fixedly connected with two pins 186 that are respectively disposed through the guide slots 184 of the two latches 172, the two pins 186 being provided at two diametrically opposite locations relative to the pivot axis 182. In this manner, the two latches 172 can concurrently slide toward each other for respectively disengaging from the two hanging bars 206 when the latch actuator 174 rotates in one direction about the pivot axis 182, and the two latches 172 can concurrently slide away from each other for respectively engaging with the two hanging bars 206 when the latch actuator 174 rotates in an opposite direction.

Figure 36:
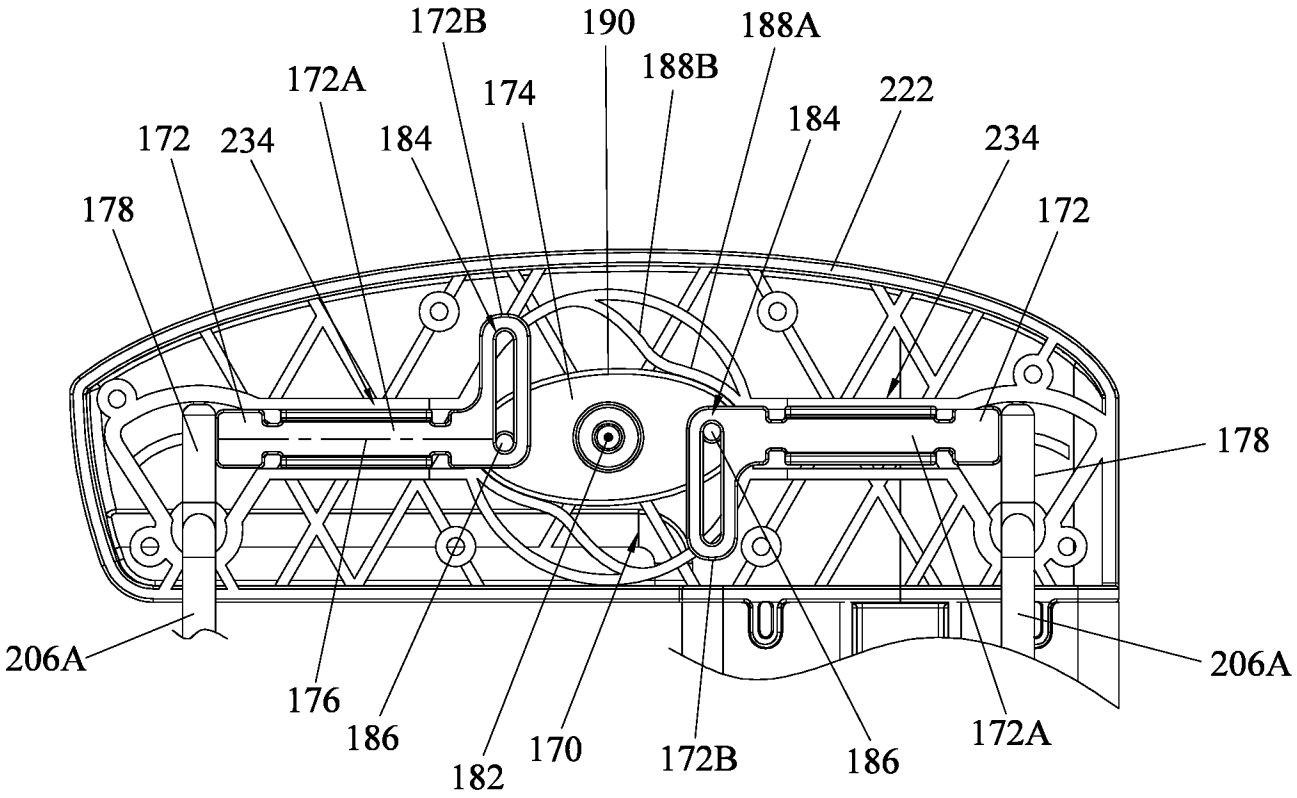
FIG. 36 is a planar view illustrating some construction details of the latching mechanism incorporated in the child care apparatus shown in FIG. 33, the latching mechanism being illustrated in the locking state.
Figure 37:
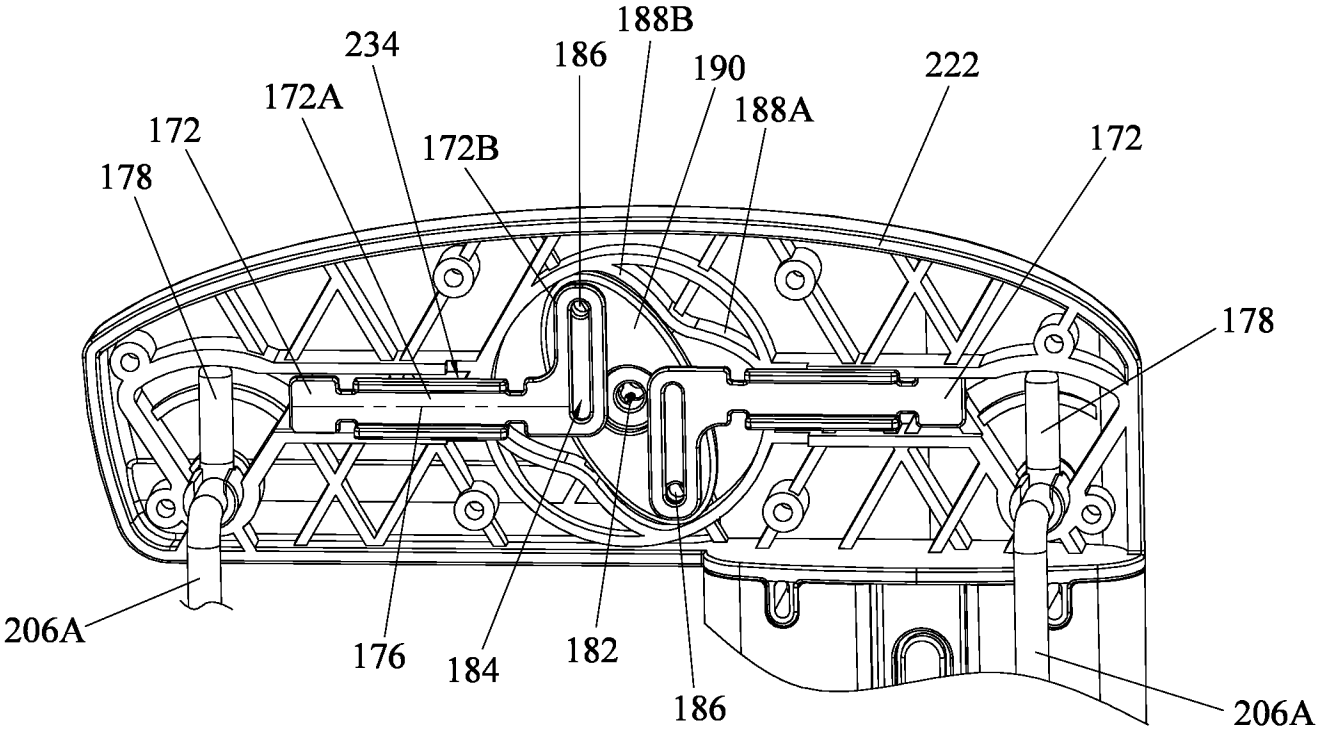
FIG. 37 is a planar view illustrating the latching mechanism incorporated in the child care apparatus of FIG. 33 in the unlocking state.

Referring to FIGS. 36 and 37, the housing 222 can have an interior provided with a plurality of ribs 188A and 188B for restricting a range of rotation of the latch actuator 174. For example, the latch actuator 174 can include a plate portion 190 of an elliptical shape to which the two pins 186 are fixedly attached, the rib 188A can contact with the plate portion 190 to stop the latch actuator 174 in the locking state as shown in FIG. 36, and the rib 188B can contact with the plate portion 190 to stop the latch actuator 174 in the unlocking state as shown in FIG. 37.

With the aforementioned construction, the latch actuator 174 can move along with the latches 172 relative to the mounting portion 214 between the locking state where the latches 172 can be respectively engaged with the hanging bars 206, and the unlocking state where the latches 172 can be respectively disengaged from the hanging bars 206. A caregiver can simply rotate the operating portion 180 of the latch actuator 174 exposed outside the mounting portion 214 for switching the latching mechanism 170 between the locking state and the unlocking state.

The child care apparatus described herein is relatively simple in construction, and has a child support frame that can be swung or locked in position as needed. Therefore the child care apparatus can have a soothing function for a child, which may be particularly suitable for bedside cribs.

Realization of the child care apparatus has been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A child care apparatus comprising:

a standing frame including a mounting portion;

a child support frame held on the standing frame via at least two hanging bars, the two hanging bars being respectively connected pivotally with the mounting portion, the two hanging bars being rotatable for swinging the child support frame; and a latching mechanism and a holding mechanism assembled with the mounting portion of the standing frame, the latching mechanism including a latch actuator linked to two latches, and a biasing element, the latch actuator being operable to move between a locking state where the two latches are respectively engaged with the two hanging bars so that the two hanging bars are locked with respect to the mounting portion, and an unlocking state where the two latches are respectively disengaged from the two hanging bars so that the two hanging bars are unlocked for movement relative to the mounting portion;

wherein the latch actuator is configured such that the biasing element applies a biasing force that biases the latch actuator toward the unlocking state; and wherein the holding mechanism includes a locking part movable to engage with and disengage from the latch actuator, the latch actuator being kept in the locking state against the biasing force of the biasing element while the locking part is engaged with the latch actuator, and the latch actuator being movable from the locking state to the unlocking state under the biasing force of the biasing element while the locking part is disengaged from the latch actuator.

2. The child care apparatus according to claim 1, wherein the two hanging bars are respectively connected with the child support frame at two spaced-apart locations.

3. The child care apparatus according to claim 1, wherein the two hanging bars are respectively connected pivotally with the child support frame.

4. The child care apparatus according to claim 1, wherein the standing frame includes two support legs respectively disposed at two opposite sides of the child support frame, and a transversal bar connected with the two support legs below the child support frame, the mounting portion being connected with an upper end of one of the two support legs.

5. The child care apparatus according to claim 1, wherein the child support frame includes an upper frame portion, a lower frame portion, and a plurality of upright posts connected with the upper and lower frame portions, the two hanging bars being connected with the lower frame portion.

6. The child care apparatus according to claim 1, wherein the mounting portion includes a housing, and the two hanging bars are respectively connected with two bar extensions that extend inside the housing away from respective pivot axes of the two hanging bars, the two latches of the latching mechanism being engaged with the two bar extensions to rotationally lock the two hanging bars with respect to the mounting portion and disengaged from the two bar extensions to rotationally unlock the two hanging bars with respect to the mounting portion.

7. The child care apparatus according to claim 6, wherein the latch actuator is provided with an operating portion exposed for operation, the latch actuator being movable along with the two latches between the locking state where the two latches are respectively engaged with the two bar extensions and the unlocking state where the two latches are respectively disengaged from the two bar extensions.

8. The child care apparatus according to claim 7, wherein the latch actuator is slidably connected with the housing, the latch actuator being slidable in a first direction to cause the two latches to respectively engage with the two bar extensions and in a second direction opposite to the first direction to cause the two latches to respectively disengage from the two bar extensions.

9. The child care apparatus according to claim 1, wherein the biasing element includes a spring connected with the latch actuator, the latch actuator being biased toward the unlocking state by the spring.

10. The child care apparatus according to claim 1, wherein the holding mechanism further includes a release button connected with the locking part and exposed for operation, the release button being operable to cause the locking part to disengage from the latch actuator so that the latch actuator and the two latches are movable under the biasing force of the biasing element from the locking state to the unlocking state.

11. The child care apparatus according to claim 1, wherein the latch actuator is slidable along a first axis, and the locking part is slidable along a second axis substantially orthogonal to the first axis.

12. The child care apparatus according to claim 1, wherein the holding mechanism further includes a spring configured to bias the locking part for engagement with the latch actuator.

13. The child care apparatus according to claim 1, wherein the locking part has a protrusion configured to engage with or disengage from an opening provided in the latch actuator for locking or releasing the latch actuator.

* * * * *